US007252157B2

(12) United States Patent
Aoki

(10) Patent No.: US 7,252,157 B2
(45) Date of Patent: Aug. 7, 2007

(54) POWER TOOL

(75) Inventor: Yonosuke Aoki, Anjo (JP)

(73) Assignee: Makita Corporation, Anjo-shi (JP)

( * ) Notice: Subject to any disclaimer, the term of this patent is extended or adjusted under 35 U.S.C. 154(b) by 2 days.

(21) Appl. No.: 10/816,532

(22) Filed: Mar. 31, 2004

(65) Prior Publication Data

US 2006/0076154 A1 Apr. 13, 2006

(30) Foreign Application Priority Data

Apr. 1, 2003 (JP) ..... 2003-098296
Jan. 26, 2004 (JP) ..... 2004-017688

(51) Int. Cl.
*B25D 17/00* (2006.01)
*B25D 17/06* (2006.01)

(52) U.S. Cl. ..... 173/162.2; 173/48; 173/212; 173/201

(58) Field of Classification Search ..... 173/200, 173/201, 210, 212, 122, 48, 29, 162.2
See application file for complete search history.

(56) References Cited

U.S. PATENT DOCUMENTS

| | | | | |
|---|---|---|---|---|
| 2,875,731 | A * | 3/1959 | Settles et al. | 173/162.2 |
| 3,024,770 | A * | 3/1962 | Alibright | 173/212 |
| 3,837,409 | A | 9/1974 | Consoli et al. | |
| 4,460,051 | A * | 7/1984 | Widmer | 173/162.1 |
| 4,478,293 | A * | 10/1984 | Weilenmann et al. | 173/162.2 |
| 4,567,951 | A * | 2/1986 | Fehrle et al. | 173/201 |
| 5,678,641 | A * | 10/1997 | Manschitz et al. | 173/48 |
| 6,112,830 | A * | 9/2000 | Ziegler et al. | 173/201 |
| 6,902,012 | B2 * | 6/2005 | Kristen et al. | 173/200 |
| 6,907,943 | B2 * | 6/2005 | Ikuta | 173/201 |
| 6,913,088 | B2 * | 7/2005 | Berger | 173/48 |
| 2002/0185288 | A1 | 12/2002 | Hanke et al. | |
| 2004/0222001 | A1 * | 11/2004 | Ikuta et al. | 173/210 |

FOREIGN PATENT DOCUMENTS

CN 1382562 A 12/2002

(Continued)

OTHER PUBLICATIONS

European Search Report for Application No. EP04007681, dated Jan. 31, 2007.

*Primary Examiner*—Rinaldi I. Rada
*Assistant Examiner*—Michelle Lopez
(74) *Attorney, Agent, or Firm*—Lahive & Cockfield, LLP; Anthony A. Laurentano, Esq.

(57) ABSTRACT

It is an object of the present invention to provide a power tool having a further improved vibration reducing performance. The representative power tool may comprise a tool bit, an actuating mechanism, a dynamic vibration reducer. The actuating mechanism drives the tool bit linearly by means of pressure fluctuations so as to cause the tool bit to perform a predetermined operation. The dynamic vibration reducer has a weight that reciprocates under a biasing force of an elastic element to reduce vibration of the actuating mechanism. The weight may be driven by means of pressure fluctuations caused in the actuating mechanism. According to the invention, the weight of the dynamic vibration reducer can be actively driven by pressure fluctuations in the actuating mechanism for driving the tool bit. Therefore, regardless of the magnitude of vibration acting on the power tool, the dynamic vibration reducer can be forcedly and steadily operated.

11 Claims, 18 Drawing Sheets

FOREIGN PATENT DOCUMENTS

| | | | |
|---|---|---|---|
| DE | 8708167 | | 11/1988 |
| DE | 19843642 | B4 | 4/2000 |
| EP | 0066779 | B1 | 12/1982 |
| JP | 52-109673 | | 9/1977 |
| JP | 09193046 | A | 7/1997 |
| RU | 2008194 | C1 | 2/1994 |
| RU | 2117572 | C1 | 8/1998 |
| RU | 2268818 | | 9/2005 |
| SU | 747714 | | 7/1980 |
| SU | 994709 | | 2/1983 |
| SU | 1051254 | | 10/1983 |
| WO | 03/024672 | A1 | 3/2003 |

* cited by examiner

POWER TOOL

BACKGROUND OF THE INVENTION

1. Field of the Invention

The present invention relates to a power tool, and more particularly, to a technique of reducing vibration in a power tool, such as a hammer and a hammer drill, which linearly drives a hammer bit at a predetermined cycle.

2. Description of the Related Art

Japanese Laid-Open Patent Publication No. 52-109673 discloses a hammer with a vibration reducing device. According to the known art, a vibration-isolating chamber is integrally formed within the body housing and a dynamic vibration reducer is housed within the vibration-isolating chamber. The dynamic vibration reducer serves to reduce vibration in relation to the amount of vibration inputted into the dynamic vibration reducer. Especially within the hammer, strong vibration may be developed in the axial direction of the hammer bit when the hammer is operated.

In the above-explained dynamic vibration reducer, the weight is disposed under the action of the biasing force of an elastic element. The dynamic vibration reducer performs a vibration reducing function by the weight being driven according to the amount of vibration that is inputted to the dynamic vibration reducer. Specifically, the dynamic vibration reducer has a passive property that the amount of vibration reduction by the dynamic vibration reducer depends on the amount of imputed vibration. On the other hand, in the actual operation using the power tool, the user who holds the power tool may possibly press the power tool strongly against the work piece in order to perform the work onto the work piece. In such a case, although vibration reduction is highly required, the vibration amount inputted to the dynamic vibration reducer may be reduced because the user strongly presses the power tool against the work piece. Thus, almost of the vibration is transmitted to the body of the user of the power tool. Therefore, dynamic vibration reducer that can alleviate the vibration without respect to the amount of vibration imputed to the dynamic vibration reducer is needed.

SUMMARY OF THE INVENTION

It is, accordingly, an object of the present invention to provide a power tool having a further improved vibration reducing performance.

According to the present invention, a representative power tool may comprise a tool bit, an actuating mechanism and a dynamic vibration reducer. The actuating mechanism drives the tool bit linearly by pressure fluctuations so as to cause the tool bit to perform a predetermined operation. A hammer bit may be a typical example of the tool bit. The tool bit may be driven directly or indirectly by pressure fluctuations in the actuating mechanism.

The dynamic vibration reducer in the present invention includes a weight and an elastic element. The weight may reciprocate under a biasing force of the elastic element. The weight of the dynamic vibration reducer may receive at least a biasing force of an elastic element and may also be constructed to additionally receive a damping force of a damping element.

The present invention has a feature that the weight is driven by pressure fluctuations caused in the actuating mechanism. The dynamic vibration reducer is inherently a mechanism that passively reduces the vibration by the weight being driven according to the input of vibration from the outside. In the present invention, the weight of the dynamic vibration reducer can be actively driven by pressure fluctuations in the actuating mechanism for driving the tool bit. Therefore, regardless of the magnitude of vibration acting on the power tool, the dynamic vibration reducer can be forcedly and steadily operated. Thus, the power tool of the present invention can effectively perform the vibration reducing function even when, for example, a user operates the power tool while applying a strong pressing force to the power tool.

Preferably, the actuating mechanism may include a driving motor, a striker and a crank mechanism. The striker reciprocates in the axial direction of the tool bit so as to cause the tool bit to reciprocate. The crank mechanism drives the striker by converting a rotating output of the driving motor to linear motion in the axial direction of the hammer bit. The dynamic vibration reducer may have a body that houses the weight. The fluctuating pressure caused within the crank chamber by driving of the crank mechanism may be introduced into the body of the dynamic vibration reducer, so that the weight is forcedly driven in the direction opposite to the reciprocating direction of the striker.

The relationship between the operation of the crank mechanism and the capacity of the crank chamber is generally as follows. When the crank mechanism is actuated such that the striker moves toward the tool bit, the capacity of the crank chamber increases. In this case, the pressure within the crank chamber decreases, compared with the pressure before the increase of the capacity of the crank chamber. To the contrary, when the crank mechanism is actuated such that the striker moves away from the tool bit, the capacity of the crank chamber decreases. In this case, the pressure within the crank chamber increases, compared with the pressure before the decrease of the capacity of the crank chamber. Thus, the pressure within the crank chamber can be fluctuated according to the movement of the striker and can be introduced into the body of the dynamic vibration reducer.

When the striker moves toward the tool bit, the weight of the dynamic vibration reducer moves away from the tool bit by utilizing the relative pressure reduction in the crank chamber. For example, it may be constructed such that the weight is pulled in a direction away from the tool bit under the action of the relatively reduced pressure in the crank chamber. When the striker moves away from the tool bit, the weight of the dynamic vibration reducer moves toward the tool bit by the relative pressure increase in the crank chamber. For example, it may be constructed such that the weight is pushed toward the tool bit under the action of the relatively increased pressure in the crank chamber. In an actual operation using the power tool, a slight time delay may be caused between the change of the capacity in the crank chamber and the movement of the striker. Therefore, the timing of the forced reciprocating movement of the weight within the dynamic vibration reducer may preferably be designed in accordance with such time delay.

The weight of the dynamic vibration reducer inherently serves to reduce vibration by being passively driven according to the input of vibration from the outside. According to the invention, such weight is adapted to function as a counter weight that actively reciprocates in a direction opposite to the striker. Thus, an efficient vibration reducing mechanism can be provided in the power tool.

Preferably, under loaded driving conditions, in which a load associated with the predetermined operation is applied to the tool bit, the weight may be allowed to be driven by fluctuating pressure developed in the actuating mechanism.

On the other hand, under unloaded driving conditions, in which a load associated with the predetermined operation is not applied to the tool bit, the weight may be prevented from being driven by fluctuating pressure developed in the actuating mechanism. With this construction, under the loaded driving conditions, in which vibration reduction is highly required, the weight of the dynamic vibration reducer can be forcedly and actively driven by utilizing the pressure fluctuations caused in the actuating mechanism, so that vibration reduction of the power tool can be effectively achieved. Further, under the unloaded driving conditions, in which vibration reduction is not so highly required, the weight of the dynamic vibration reducer can be prevented from being driven actively so that the weight is prevented from causing vibration of the power tool.

Preferably, the dynamic vibration reducer may include a first actuating chamber and a second actuating chamber that are defined on the both sides of the weight within the body. At least under the loaded driving conditions, the fluctuating pressure developed in the actuating mechanism is introduced into the first actuating chamber, and the second actuating chamber can communicate with the outside.

With this construction, under the loaded driving conditions, the weight of the dynamic vibration reducer is driven by introducing the fluctuating pressure of the actuating mechanism into the first actuating chamber, so that the dynamic vibration reducer can function as an active vibration reducing mechanism. In this case, the second actuation chamber in the body may be arranged in communication with the outside. With such arrangement, the movement of the weight in the body is prevented from being interfered by expansion or compression (typically, adiabatic expansion or compression) of the second actuation chamber of which communication with the outside is interrupted. Thus, smooth and quick movement of the weight in the body can be ensured.

In order to additionally provide an element for reducing vibration by damping in the dynamic vibration reducer, preferably, fluid, such as air or oil, may be appropriately charged into the first and second actuation chambers.

Preferably, the actuating mechanism may include a piston and a cylinder that slide relative to each other in the axial direction of the tool bit. The tool bit reciprocates in its axial direction by the action of an air spring which is caused by relative movement of the piston and the cylinder. The weight of the dynamic vibration reducer is disposed along the circumferential surface of the cylinder and can slide in the axial direction of the tool bit. In order to dispose the weight along the circumferential surface, the weight may be disposed fully or partly around the outer circumferential surface of the cylinder. Thus, the weight is disposed along the circumferential surface of the cylinder and can be caused to reciprocate sliding along the cylinder. Thus, miniaturization of the power tool can be achieved.

Further, the representative power tool may preferably include a cylinder adapted and arranged to move between a first position near the tool holder and a second position remote from tool holder than the first position. And, under loaded driving conditions in which a load associated with the predetermined operation is applied to the tool bit, the cylinder may move to the second position so as to allow the weight to be driven by means of fluctuating pressure within the crank chamber. Otherwise, under unloaded driving conditions in which a load associated with the predetermined operation is not applied to the tool bit, the cylinder may move to the first position so as to prevent the weight from being driven by means of fluctuating pressure within the crank chamber.

With such construction, the switching control between the forced vibration state and the forced-vibration disabled state can be achieved by the movement of the cylinder between the first position and the second position. Within the forced vibration state, the weight of the dynamic vibration reducer is actively driven under the loaded driving conditions. On the other hand, within the forced-vibration disabled state, the weight of the dynamic vibration reducer is not actively driven under the unloaded driving conditions. The cylinder is an already-existing component part of the power tool which houses the striker. Therefore, the number of parts of the power tool can be reduced and the construction can be made simpler. The manner of "allowing the weight to be driven by fluctuating pressure within the crank chamber" in this invention means the manner of introducing the fluctuating pressure of the crank chamber into the body of the dynamic vibration reducer. The manner of "preventing the weight from being driven" typically means the manner of preventing the pressure within the crank chamber from fluctuating, but also suitably embraces the manner of preventing the fluctuating pressure of the crank chamber from being introduced into the body of the dynamic vibration reducer.

Preferably, the cylinder may have an air spring chamber that causes the striker to reciprocate by the action of an air spring. The air spring action may be caused due to an compression by the actuating mechanism. Under the loaded driving conditions in which a load associated with the predetermined operation is applied to the tool bit, the cylinder moves to the second position, thereby allowing the striker to be driven by the action of the air spring function of the air spring chamber. Under unloaded driving conditions in which a load associated with the predetermined operation is not applied to the tool bit, the cylinder moves to the first position, thereby preventing the striker from being driven by the action of the air spring function of the air spring chamber.

Preferably, under the loaded driving conditions, the weight may be allowed to be driven by fluctuating pressure within the crank chamber with a time delay after the striker is allowed to be driven by the action of the air spring function of the air spring chamber. Under the actual loaded driving conditions of the tool bit, after the pressure within the air spring chamber starts to be compressed by driving of the actuating mechanism, the striker starts to move by the compressed pressure with a slight time delay (by the compression time required for the air spring to actually act on the striker). Otherwise, the striker starts to move linearly toward the tool bit with a slight time delay due to the inertial force of the striker or other similar factors. Therefore, the forced vibration of the dynamic vibration reducer may start with a time delay after the prevention of idle hammering is disabled. Thus, the weight of the dynamic vibration reducer can be controlled in the timing of movement such that the weight starts to move linearly in the direction opposite to the movement of the striker. As a result, the vibration reducing function can be suitably performed.

Preferably, the power tool may further comprise an air vent that can communicate the crank chamber with the outside. When the cylinder moves to the second position, the air vent is closed, thereby allowing the weight to be driven. When the cylinder moves to the first position, the air vent is opened, thereby preventing the weight to be driven. Thus, with the construction in which the air vent is opened and closed by the movement of the cylinder, the cylinder and the circumferential portion around the cylinder on which the cylinder slides may define a sealing surface. As a result, satisfactory sealing can be ensured, so that the effectiveness of the forced vibration of the dynamic vibration reducer can be enhanced. Further, with the construction in which the crank chamber communicates with the outside during the unloaded driving conditions, pressure fluctuations within the crank chamber and resistance caused by pressure increase can be avoided. Thus, useless consumption of energy can be prevented.

Preferably, the power tool may further comprise an air vent that can communicate the air spring chamber with the outside. The air vent is closed when the cylinder moves to the second position and the air vent is opened when the cylinder moves to the first position. With this construction, when the air vent is opened, the air spring chamber communicates with the outside. Thus, the pressure within the air spring chamber does not fluctuate even if the actuating mechanism is driven. As a result, the actuating mechanism idles, so that the idle hammering of the tool bit, namely the hammering action when the tool bit is not engaged with the work piece, can be prevented. On the other hand, when the air vent is closed, communication of the air spring chamber with the outside is interrupted, so that the pressure fluctuation of the air spring chamber is allowed. Thus, the prevention of idle hammering is disabled, and the striker can be driven by the air spring function. With this construction, both the switching between the forced vibration and its disabling and the switching between the prevention of idle hammering of the tool bit and its disabling can be achieved by utilizing the movement of the single cylinder. Thus, the hammer can be much simpler in construction.

DETAILED DESCRIPTION OF THE REPRESENTATIVE EMBODIMENT OF INVENTION

First Embodiment

Figure 1:
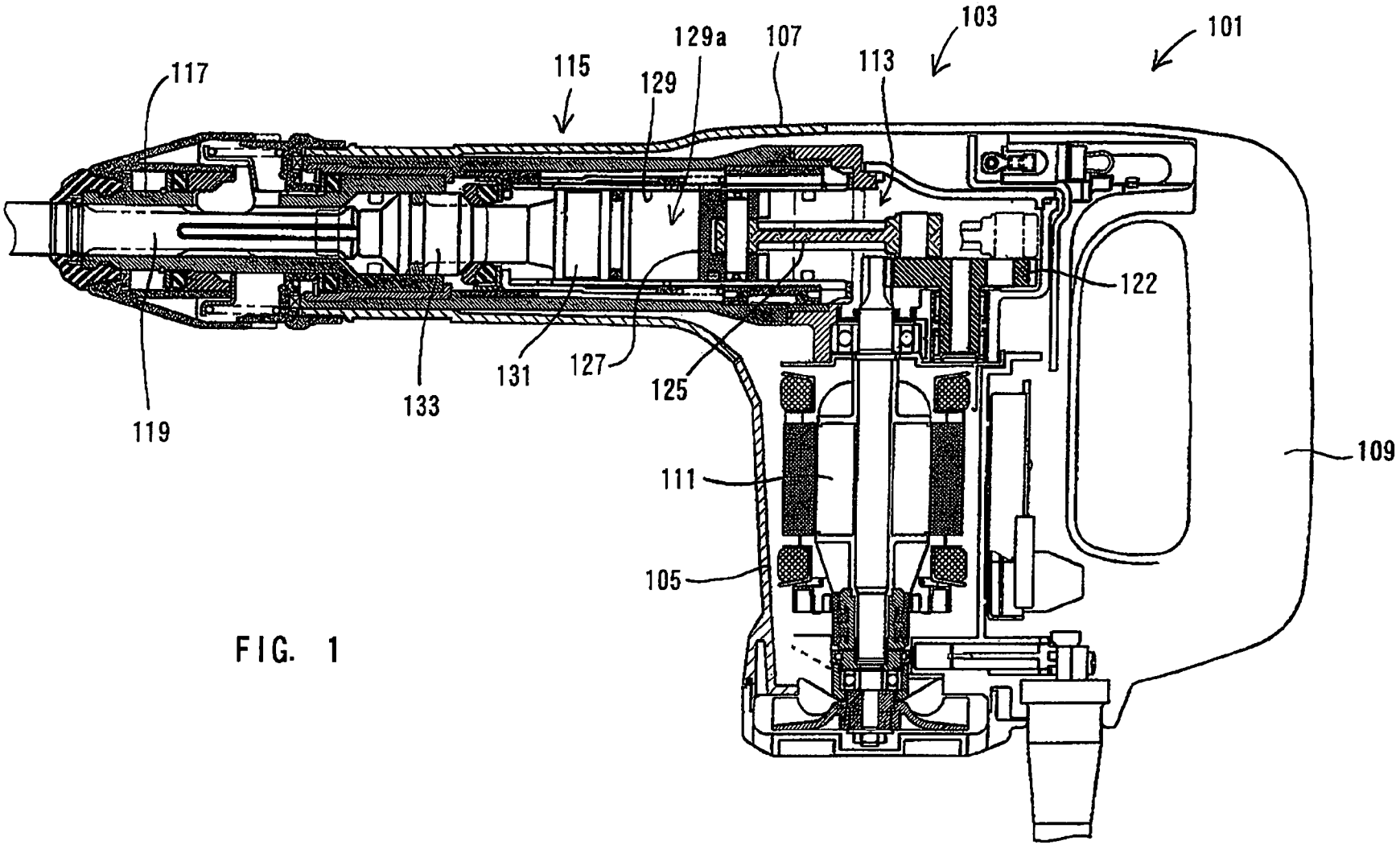
FIG. 1 is a sectional view showing an entire hammer according to the first embodiment of the invention.

A first embodiment of the present invention will now be described with reference to FIGS. 1 to 5. An electric hammer will be explained as a representative example of the power tool according to the present invention. As shown in FIG. 1, a representative electric hammer 101 according to this embodiment comprises a body 103, a tool holder 117 connected to the tip end region of the body 103, and a hammer bit 119 that is detachably coupled to the tool holder 117. The hammer bit 119 is a feature that corresponds to the "tool bit" according to the present invention.

The body 103 includes a motor housing 105 that houses a driving motor 111, a gear housing 107 that houses a motion converting mechanism 113 and a striking element 115, and a handgrip 109. The motion converting mechanism 113 is adapted to appropriately convert the rotating output of the driving motor 111 to linear motion and then to transmit it to the striking element 115. As a result, an impact force is generated in the axial direction of the hammer bit 119 via the striking element 115. The electric hammer 101 may be configured such that it can be switched to a hammer drill mode in which the hammering operation in the axial direction of the hammer bit 119 and the drilling operation in the circumferential direction can be performed at the same time.

Figure 2:
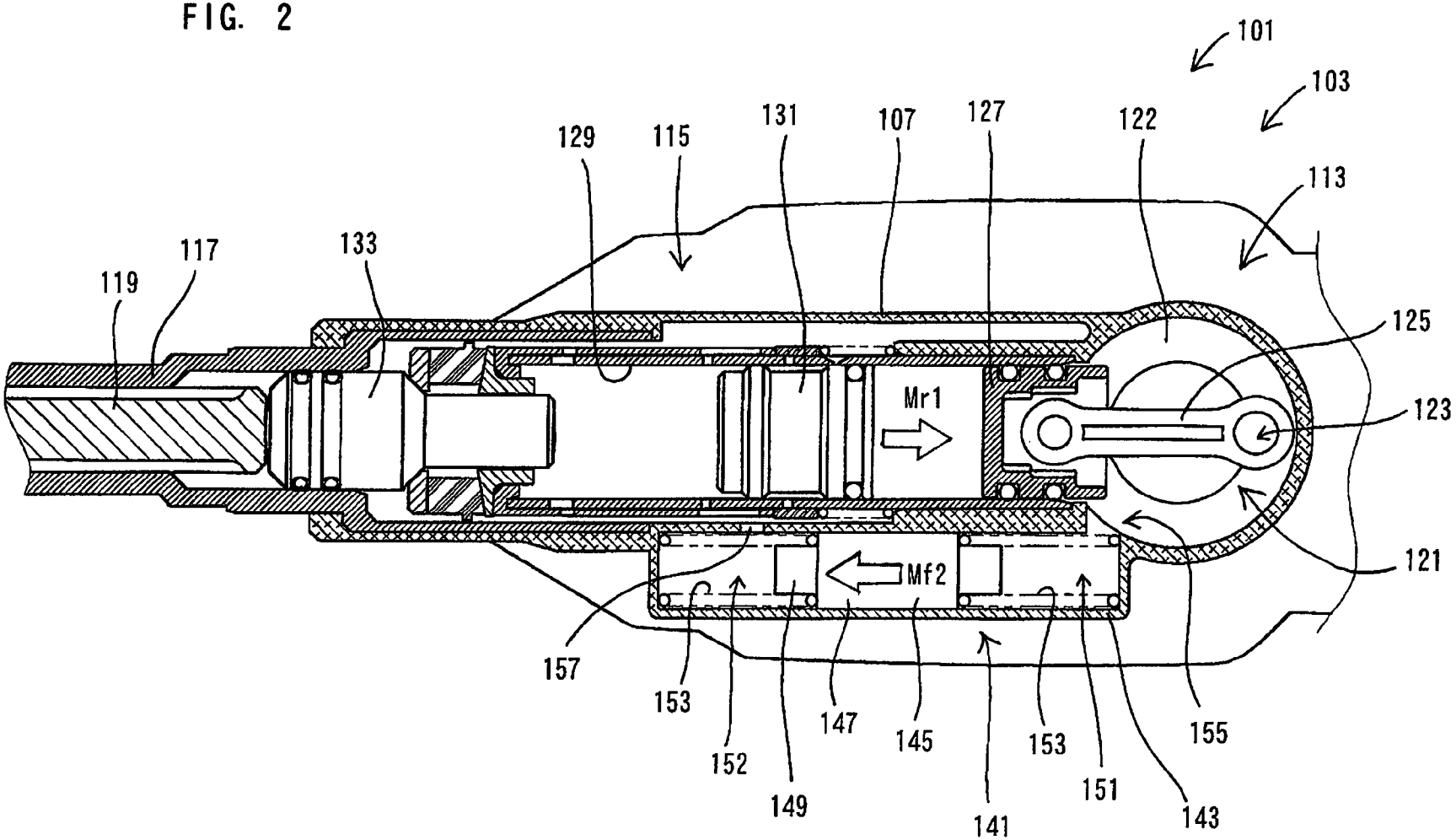
FIG. 2 is a sectional plan view of an essential part of the electric hammer of the first embodiment, showing a piston at a non-compression side dead point.

FIG.2 shows a detailed construction of the motion converting mechanism 113 and the striking element 115 of the electric hammer 101. FIG. 2 schematically shows an essential part of the electric hammer 101 in plan view. The motion converting mechanism 113 includes a driving gear 122, an eccentric shaft 123 and a crank arm 125. The driving gear 122 is rotated in a horizontal plane by the driving motor 111 (see FIG. 1). The eccentric shaft 123 is eccentrically disposed in a position displaced from the center of rotation of the driving gear 122. One end of the crank arm 125 is loosely connected to the eccentric shaft 123 and the other end is loosely connected to a driver 127. The driving gear 122, the eccentric shaft 123 and the crank arm 125 are disposed within a crank chamber 121. The crank chamber 121 is configured such that it is substantially sealed from the outside by a sealing structure which is not particularly shown and such that its effective capacity can increase and decrease according to the movement of the driver 127 that is caused by the crank arm 125. The crank arm 125 and the driver 127 form a feature that corresponds to the "crank mechanism" according to the present invention. Further, the driver 127 corresponds to the feature "piston" according to the present invention.

A striking mechanism 115 mainly includes a striker 131 and an impact bolt 133. The striker 131 is slidably disposed within the bore of a cylinder 129 together with the driver 127. The impact bolt 133 is slidably disposed within the tool holder 117 and is adapted to transmit the kinetic energy of the striker 131 to the hammer bit 119.

Further, as shown in FIG. 2, the hammer 101 includes a dynamic vibration reducer 141 that is connected to the body 103. The dynamic vibration reducer 141 mainly includes a cylindrical body 143 that is disposed adjacent to the body 103, a weight 145 that is disposed within the cylindrical body 143, and biasing springs that are disposed on the right and left sides of the weight 145. The biasing springs 153 exert a biasing force on the weight 145 in a direction toward each other when the weight 145 moves in the axial direction of the cylindrical body 143 (in the axial direction of the hammer bit 119). A first actuation chamber 151 and a second actuation chamber 152 are defined on the both sides of the weight 145 within the cylindrical body 143. The first actuation chamber 151 communicates with the crank chamber 121 via a first communicating portion 155. The second actuation chamber 152 communicates with the outside of the dynamic vibration reducer 141 (the atmosphere) via a second communicating portion 157.

The weight 145 has a large-diameter portion 147 and a small-diameter portion 149 contiguously formed with the large-diameter portion 147. The dimensions of the weight 145 can be appropriately adjusted in design by selectively determining the configuration and the axial length of the large-diameter portion 147 and the small-diameter portion 149. Thus, the weight 145 can be made smaller in its entirety. Further, the weight 145 is elongated in the direction of its movement and each of the biasing spring 153 is tightly fitted around the small-diameter portion 149, so that the movement of the weight 145 in the axial direction of the hammer bit 119 can be stabilized.

Although the dynamic vibration reducer 141 in the present embodiment is fixedly connected to the body 103 (the gear housing 107) and thus integrally mounted on the electric hammer 101, it may be configured to be detachable from the body 103.

Operation of the hammer 101 constructed as described above will now be explained. When the driving motor 111 (shown in FIG. 1) is driven, the rotating output of the driving motor 111 causes the driving gear 122 (shown in FIG. 2) to rotate in the horizontal plane. When the driving gear 122 rotates, the eccentric shaft 123 revolves in the horizontal plane, which in turn causes the crank arm 125 to swing in the horizontal plane. The driver 127 on the end of the crank arm 125 then slidingly reciprocates within the bore of the cylinder 129. When the driver 127 reciprocates, the striker 131 reciprocates within the cylinder 129 and collides with the impact bolt 133 at a speed higher than the driver 127 by the action of the air spring function as a result of the compression of the air within the cylinder 147 between the striker and the impact bolt. The kinetic energy of the striker 131 which is caused by the collision with the impact bolt 133 is transmitted to the hammer bit 119. Thus, the hammering operation is performed on a workpiece (not shown). In FIG. 2, in convenience of illustration, the driver 127 is shown in a retracted position at a non-compression side dead point, and thus the striker 131 which has collided with the impact bolt 133 and transmitted the impact force to the hammer bit 119 is shown moving linearly away from the hammer bit (in the direction shown by arrow Mr1 in FIG. 2).

The dynamic vibration reducer 141 on the body 103 serves to reduce impulsive and cyclic vibration caused when the hammer bit 119 is driven as mentioned above. Specifically, the weight 147 and the biasing springs 153 cooperate to passively reduce vibration of the body 103 on which a predetermined outside force (vibration) is exerted. Thus, the vibration of the hammer 101 of this embodiment can be effectively alleviated or reduced. The principle of reducing vibration by using a dynamic vibration reducer is a known art and therefore, will not be described in detail.

Figure 3:
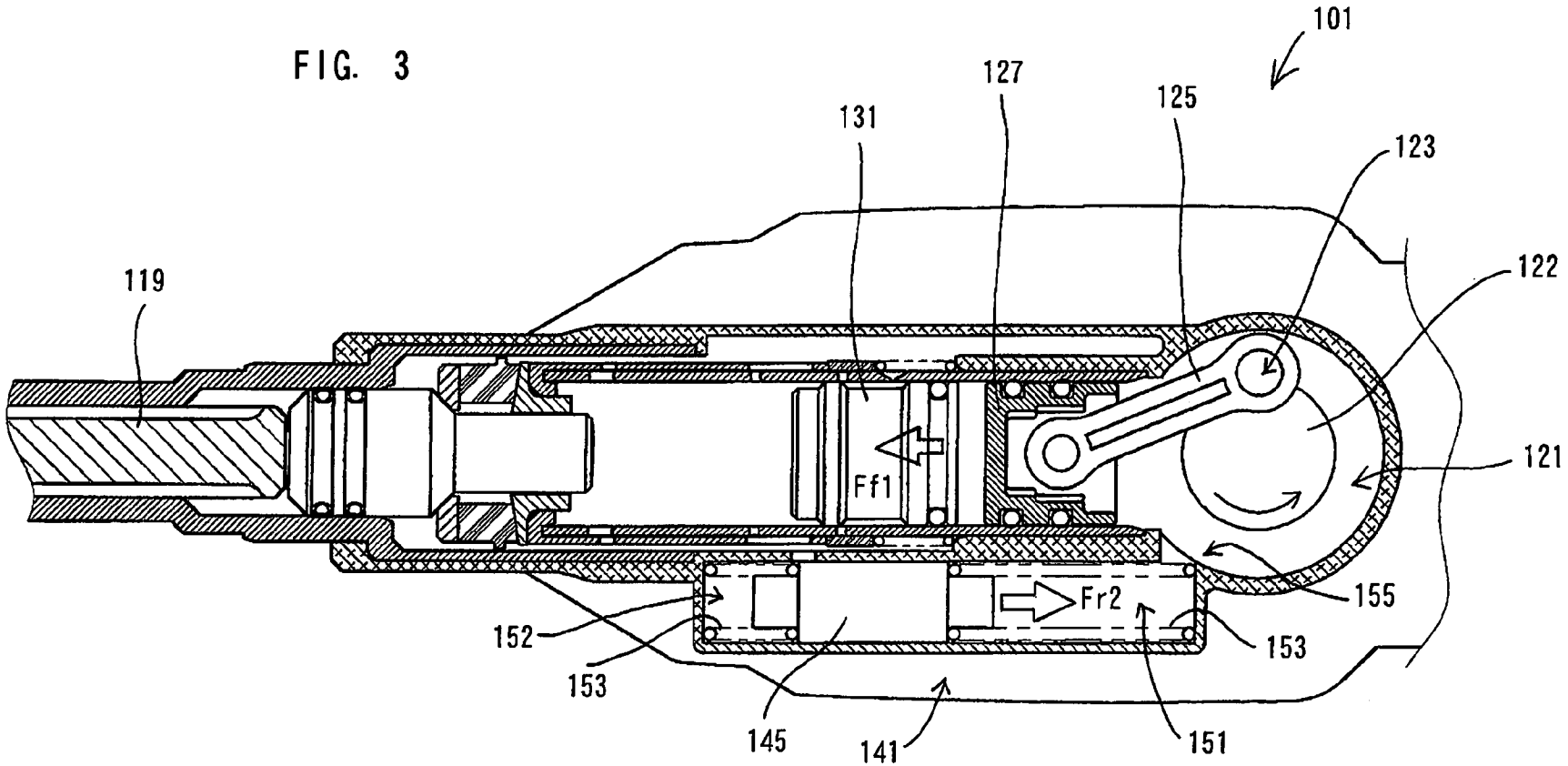
FIG. 3 is also a sectional plan view of the electric hammer of the first embodiment, showing the piston starting to move from the position shown in FIG. 2 toward the compression side.

When the hammer 101 is driven, the capacity within the crank chamber 121 changes as the driver 127 reciprocates in the axial direction of the hammer bit 119 within the cylinder 129. For example, in FIG. 3, the driver 127 is shown moved a predetermined distance toward the hammer bit 119 from the position shown in FIG. 2 at the non-compression side dead point. In FIG. 3, the crank arm 124 swings in the horizontal plane as the driving gear 122 rotates counterclockwise as viewed in the drawing. As a result, the driver 127 starts to slide toward the hammer bit 119. At this time, a force Ff1 acts on the striker 131 in a direction toward the hammer bit 119 by the action of the air spring function between the striker 131 and the driver 127.

At this time, the capacity within the crank chamber 121 increases and the pressure within the crank chamber 121 reduces as the driver 127 slides toward the hammer bit 119. The reduced pressure acts on the first actuation chamber 151 of the dynamic vibration reducer 141 via the communicating portion 155. As a result, a force Fr2 acts on the weight 145 in a direction away from the hammer bit 119.

Figure 4:
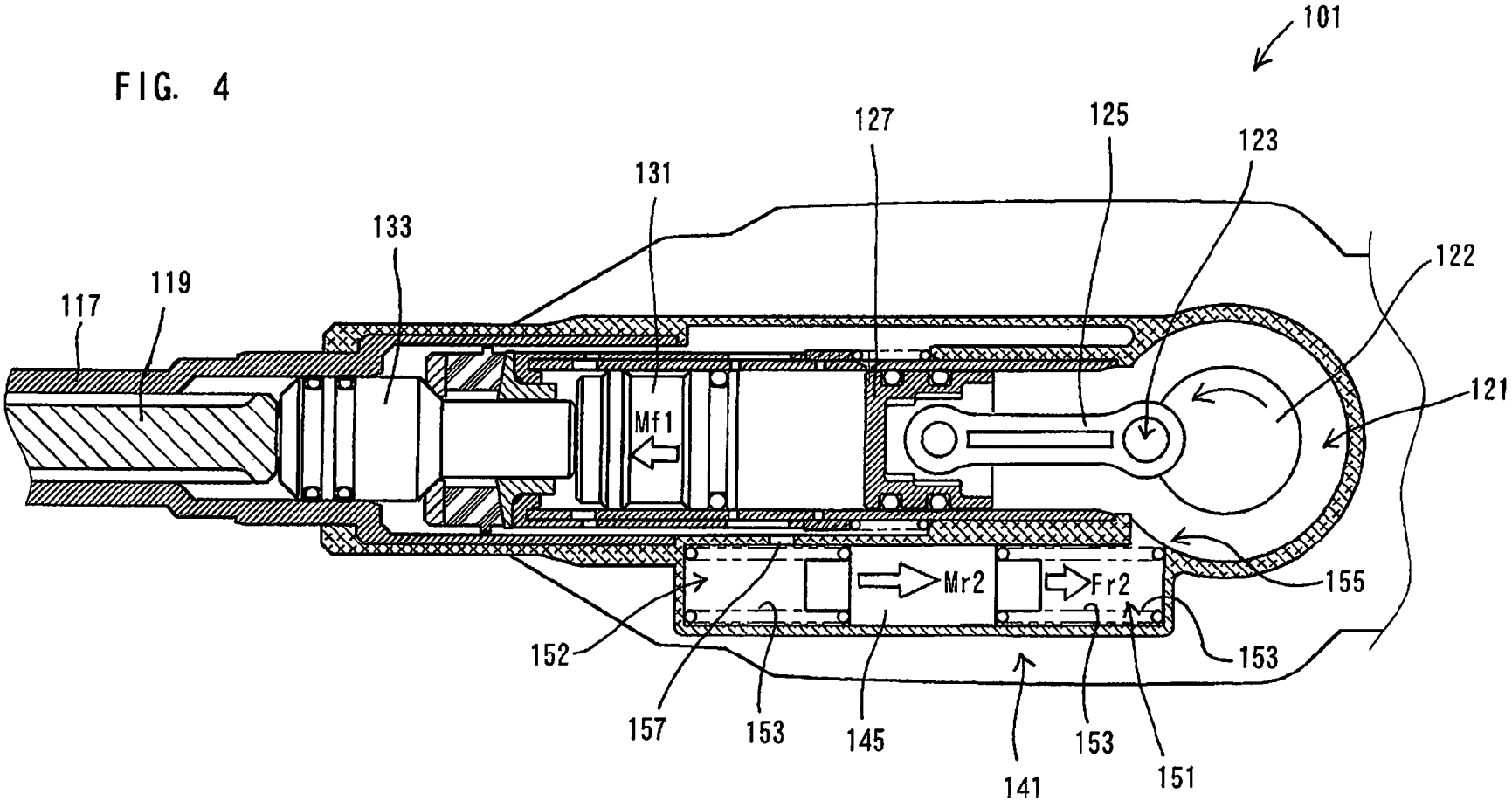
FIG. 4 shows the piston having moved to the compression side dead point.

As shown in FIG. 4, when the driving gear 122 is further rotated, the crank arm 125 further swings in the horizontal plane and the driver 127 further slides toward the hammer bit 119 until it reaches a compression side dead point. At this time, the striker 131 moves toward the hammer bit 119 (in a direction shown by arrow Mf1) from the state shown in FIG. 3 and collides with the impact bolt 133 by the continuous action of the air spring function. As a result, the impulsive striking force is transmitted to the hammer bit 119, and the hammer bit 119 reciprocates within the tool holder 117 and thus performs a hammering operation.

At this time, the pressure within the crank chamber 121 which has been reduced due to increase of the capacity within the crank chamber 121 is continuously applied to the inside of the first actuation chamber 151 from the state shown in FIG. 3 to the state shown in FIG. 4. Thus, the force Fr2 continuously acts on the weight 145. As a result, the weight 145 slides rightward as viewed in the drawing (away from the hammer bit 119 in the direction shown by arrow Mr2) against the biasing force of the biasing spring 153. As a result, when the striker 131 collides with the impact bolt 133 and reciprocates in such a manner that it applies the impact force to the hammer bit 119, the weight 145 reciprocates in a direction opposite to the reciprocating direction of the striker 131, thereby reducing the vibration of the hammer 101.

After the driver 127 starts to move toward the striker 131, the striker 131 actually starts to move toward the impact bolt 133 with a slight time delay due to the compression time required for actuation of the air spring, the inertial force of the striker 131 or other similar factors. Therefore, preferably, the timing for causing the weight 145 of the dynamic vibration reducer 141 to start the linear movement may be appropriately arranged for example by adjusting the biasing force of the biasing spring 153.

Further, in this embodiment, when the weight 145 moves linearly in a direction opposite to the moving direction of the striker 131, outside air is introduced into the second actuation chamber 152 via the second communicating portion 157 of the second actuation chamber 152. Thus, the linear movement of the weight 145 can be effectively prevented from being interfered by the inside space of the second actuation chamber 152 being expanded in a state in which outside air cannot be introduced (adiabatic expansion) when the weight 145 moves rightward as viewed in the drawing.

Further, as the weight 145 moves rightward as viewed in the drawing, the capacity within the first actuation chamber 151 reduces and the pressure within the crank chamber 121 increases via the first communicating portion 155. It can be arranged and configured such that the effective capacity of the crank chamber 121 is increased by a practically negligible amount. Or it may be arranged and configured such that above-described pressure increase causes a braking action on the movement Mr2 of the weight 145 such that the weight 145 is prevented from colliding with the end of the first actuation chamber 151.

Figure 5:
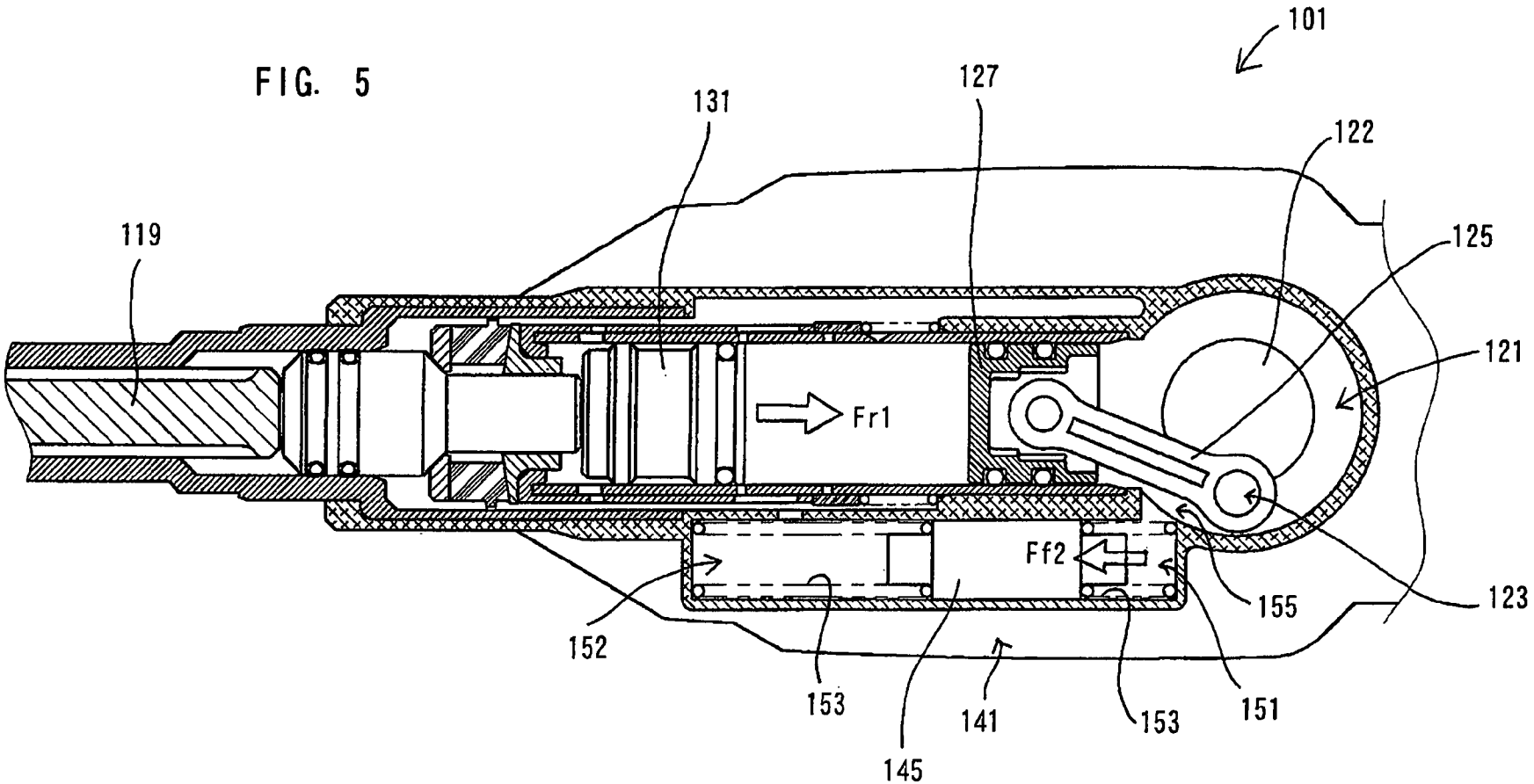
FIG. 5 shows the piston starting to move from the compression side dead point to the non-compression side dead point.

When the driving gear 122 is further rotated from the state in which the driver 127 is located at the compression side dead point as shown in FIG. 4, the driver 127 moves away from the hammer bit 119. As a result, as shown in FIG. 5, force Fr1 acts on the striker 131 in the direction away from the hammer bit 119 by the air spring acting on the expansion side. At this time, as the capacity within the crank chamber 121 reduces and the pressure within the crank chamber 121 increases, a force Ff2 acts on the weight 145 of the dynamic vibration reducer 141 in the direction toward the hammer bit 119 by the action of the fluctuating pressure that is applied to the first actuation chamber 151 via the communicating portion 155. As described above, due to the time required for actuation of the air spring, the inertial force of the striker 131 or other similar factors, the striker 131 starts to move linearly with a slight time delay after the driver 127 starts to move away from the hammer bit 119. As a result, in the process in which the driver 127 moves from the state shown in FIG. 5 to the non-compression dead point shown in FIG. 2, the striker 131 starts the linear movement Mr1 in a direction away from the hammer bit 119 (see FIG. 2). At the same time, the weight 145 of the dynamic vibration reducer 141 starts the linear movement Mf2 in a direction opposite to the direction of the linear movement of the striker 131. As a result, even when the striker 131 retracts, the vibration reducing mechanism effectively functions by actively driving the weight 145.

When the weight 145 moves linearly leftward as viewed in the drawing (see FIG. 2), outside air is introduced into the second actuation chamber 152 via the second communicating portion 157. Thus, in this embodiment, the linear movement of the weight 145 is not interfered by the inside space of the second actuation chamber 152 being compressed in a state in which outside air cannot be introduced (adiabatic compression) when the weight 145 moves leftward as viewed in the drawing.

Inherently, in the dynamic vibration reducer 141, the weight 145 is driven according to the vibration inputted from the outside, thereby passively reducing vibration. According to the representative embodiment, the weight 145 is caused to forcedly and actively reciprocate in a direction opposite to the reciprocating direction of the striker 131 by utilizing pressure fluctuations within the crank chamber 121 which is caused by driving movement of the driver 127. Therefore, regardless of the magnitude of vibration on the hammer 101, the dynamic vibration reducer 141 can be operated steadily. In other words, the weight 145 of the dynamic vibration reducer 141 can be used like a counter weight that is actively driven by a motion converting mechanism. Such construction is particularly advantageous when a user operates the hammer 101 while applying a strong pressing force to the hammer 101. Specifically, the power tool can ensure a sufficient vibration reducing function by actively driving the weight 145 even when the total amount of vibration inputted to the dynamic vibration reducer 141 is small.

Second Embodiment

A second embodiment of the present invention will now be described with reference to FIGS. 6 and 7. In the second embodiment, a weight 245 of a dynamic vibration reducer 241 can be actively driven only under the loaded driving conditions in which a load is applied from the workpiece side to a hammer bit 219. For this purpose, a cylindrical actuating element 261 and a biasing spring 263 are fitted around a cylinder 229.

Figure 6:
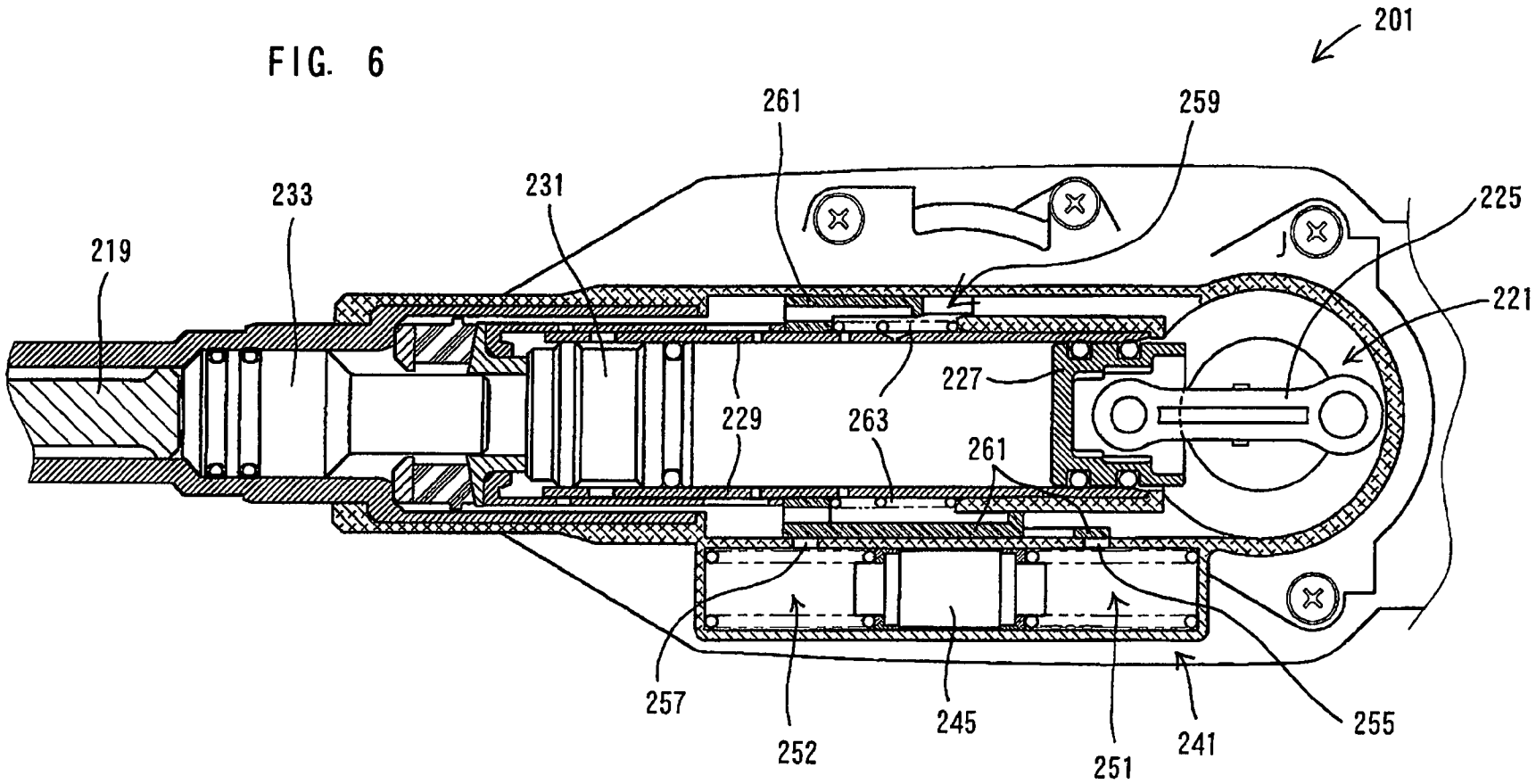
FIG. 6 shows an essential part of an electric hammer of a second embodiment of the invention under unloaded driving conditions.

In FIG. 6, a hammer 201 is shown under the unloaded driving conditions in which no load is applied from the workpiece side to the hammer bit 219. At this time, the actuating element 261 is biased leftward as viewed in the drawing by the biasing spring 263. In this state, the actuating element 261 closes a first communicating portion 255 that communicates a first actuation chamber 251 of the dynamic vibration reducer 241 with the crank chamber 221. The actuating element 261 also closes a second communicating portion 257 that communicates a second actuation chamber 252 of the dynamic vibration reducer 241 with the outside. Further, the actuating element 261 opens a third communicating portion 259 that communicates the crank chamber 221 with the outside via a compression chamber that is defined between a driver 227 and a striker 231.

As a result, under the unloaded driving conditions, the crank chamber 221 communicates with the outside via the third communicating portion 259 and not with the first actuation chamber 251 via the first communicating portion 255. Therefore, the weight 245 is not forcedly driven by utilizing pressure fluctuations within the crank chamber 221. Thus, under the unloaded driving conditions, in which vibration reduction is not so highly required, the weight 245 is prevented from being driven so that the weight 245 is prevented from causing vibration of the hammer 201. As a result, the dynamic vibration reducer 241 functions as an inherently passive vibration reducing mechanism according to the vibration inputted from the outside.

Figure 7:
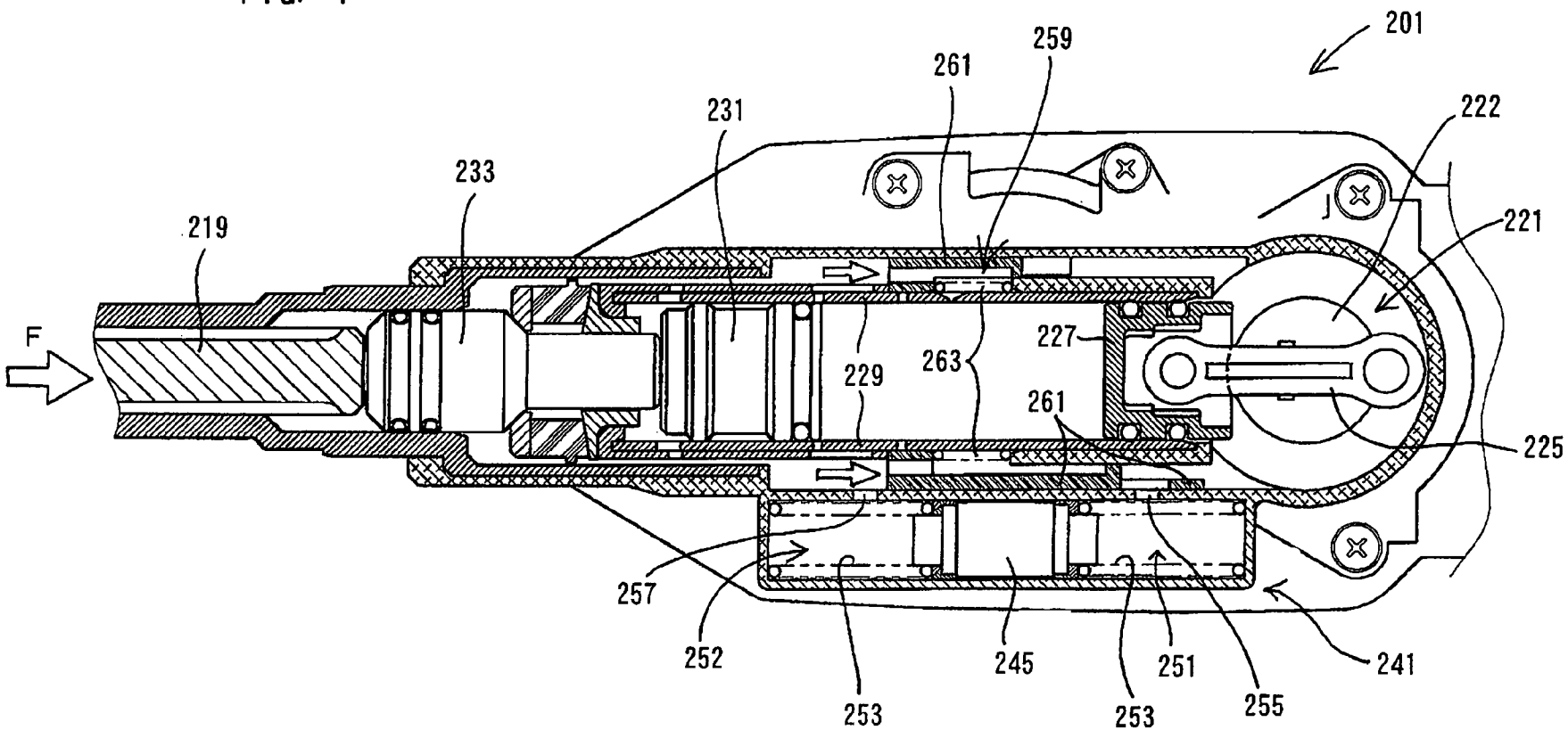
FIG. 7 also shows an essential part of the electric hammer of the second embodiment under loaded driving conditions.

As shown in FIG. 7, in a hammering operation on the workpiece by using the hammer 201, when the user presses the hammer 201, a load from the workpiece side (reaction force against the pressing force) F is applied to the hammer bit 219. Such state is defined as loaded driving conditions. Under the loaded driving conditions, the actuating element 261 slides along the cylinder 229 away from the hammer bit 219 against the biasing force of the biasing spring 263 by the pressing force applied by the user to the hammer 201. Then, the actuating element 261 opens the first communicating portion 255 and the second communicating portion 257 which have been held closed under the unloaded driving conditions, and closes the third communicating portion 259 which has been held opened. As a result, the crank chamber 221 is prevented from communicating with the outside and is brought in communication with the first actuation chamber 251 of the dynamic vibration reducer 241.

In this state, a driving gear 222 rotates and a driver 227 reciprocates via a crank arm 225. Then, a striker 231 reciprocates and transmits the impact force to the hammer bit 219 via an impact bolt 233. Thus, the hammer 201 is driven under the loaded driving conditions. At this time, when the capacity and thus the pressure within the crank chamber 221 fluctuates, such fluctuating pressure acts on the first actuation chamber 251 via the first communicating portion 255. As a result, like in the first embodiment, the weight 245 is caused to reciprocate in a direction opposite to the reciprocating direction of the striker 231, so that the vibration of the hammer 201 can be effectively reduced.

When the weight 245 is actively driven by utilizing pressure fluctuations of the crank chamber 221 under the loaded driving conditions, the second actuation chamber 252 is opened to the outside via the second communicating portion 257. Thus, the movement of the weight 145 is effectively prevented from being interfered by adiabatic expansion or compression of the second actuation chamber 252. The other components or elements in the second embodiment are substantially identical to those in the first embodiment and thus will not be described in detail.

Third Embodiment

A third embodiment of the present invention will now be described with reference to FIGS. 8 and 9. Like the second embodiment, the third embodiment is also constructed such that a weight 345 of a dynamic vibration reducer 341 can be actively driven only under the loaded driving conditions in which a load is applied from the workpiece side to a hammer bit 319. However, the third embodiment is different in construction from the second embodiment in the communicating state of a crank chamber 321 in the loaded and unloaded driving conditions. In a hammer 301 according to this embodiment, a cylindrical actuating element 361 and a biasing spring 363 are fitted around a cylinder 329. The crank chamber 221 is always in communication with a first actuation chamber 351 of the dynamic vibration reducer 341 via a first communicating portion 355.

Figure 8:
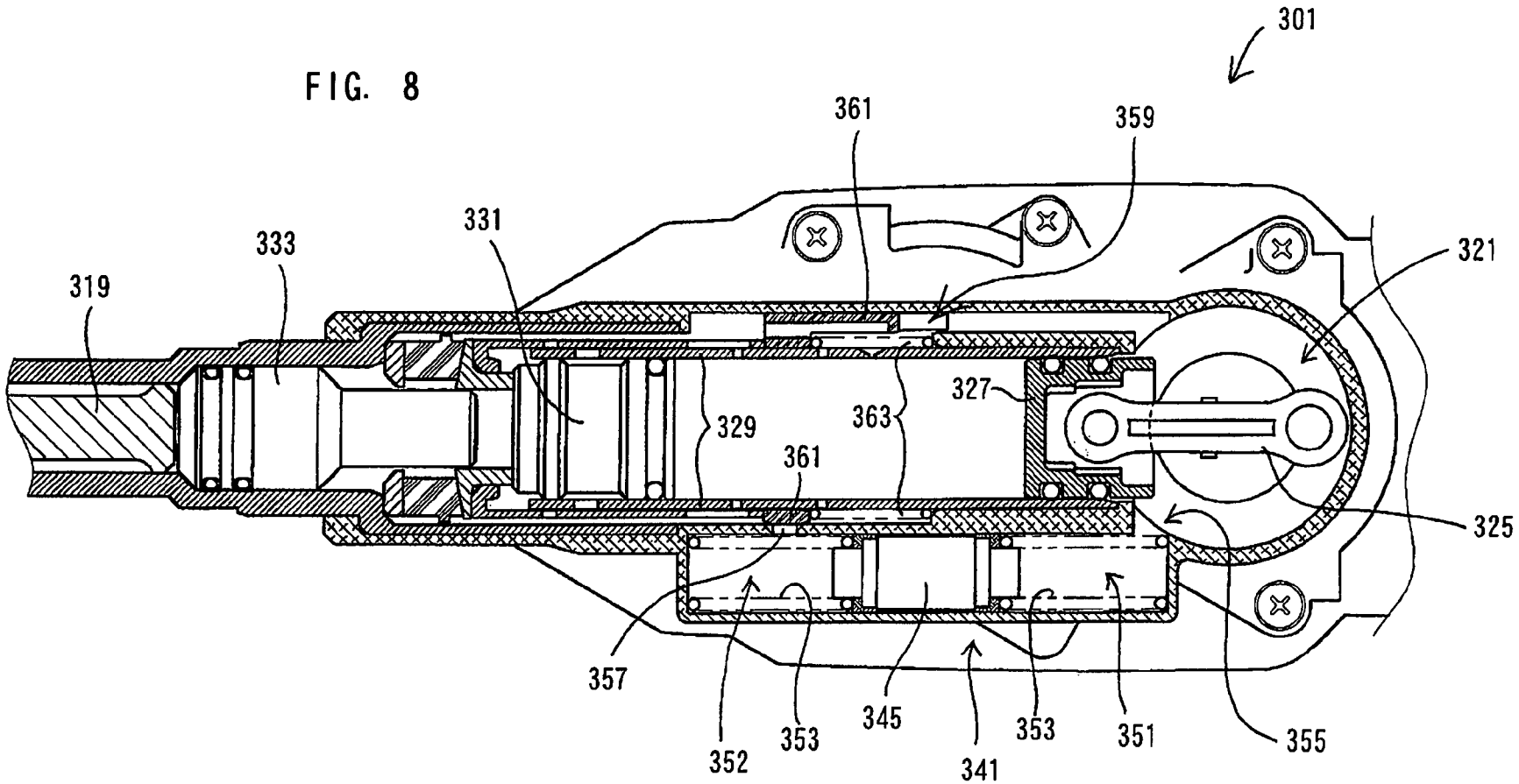
FIG. 8 shows an essential part of an electric hammer of a third embodiment of the invention under unloaded driving conditions.

In FIG. 8, the hammer 301 is shown under the unloaded driving conditions in which no load is applied from the side of the workpiece (not shown) to the hammer bit 319. At this time, the actuating element 361 is biased leftward as viewed in the drawing by the biasing spring 363. In this state, the actuating element 361 closes a second communicating portion 357 that communicates a second actuation chamber 352 of the dynamic vibration reducer 341 with the outside, while opening a third communicating portion 359 that communicates the crank chamber 321 with the outside.

As a result, under the unloaded driving conditions, the crank chamber 321 communicates with the outside via the third communicating portion 359, so that the weight 345 is not actively driven by utilizing pressure fluctuations within the crank chamber 321. Thus, under the unloaded driving conditions, in which vibration reduction is not so highly required, the weight 345 is prevented from being carelessly driven actively and thus causing vibration of the hammer 301.

Figure 9:
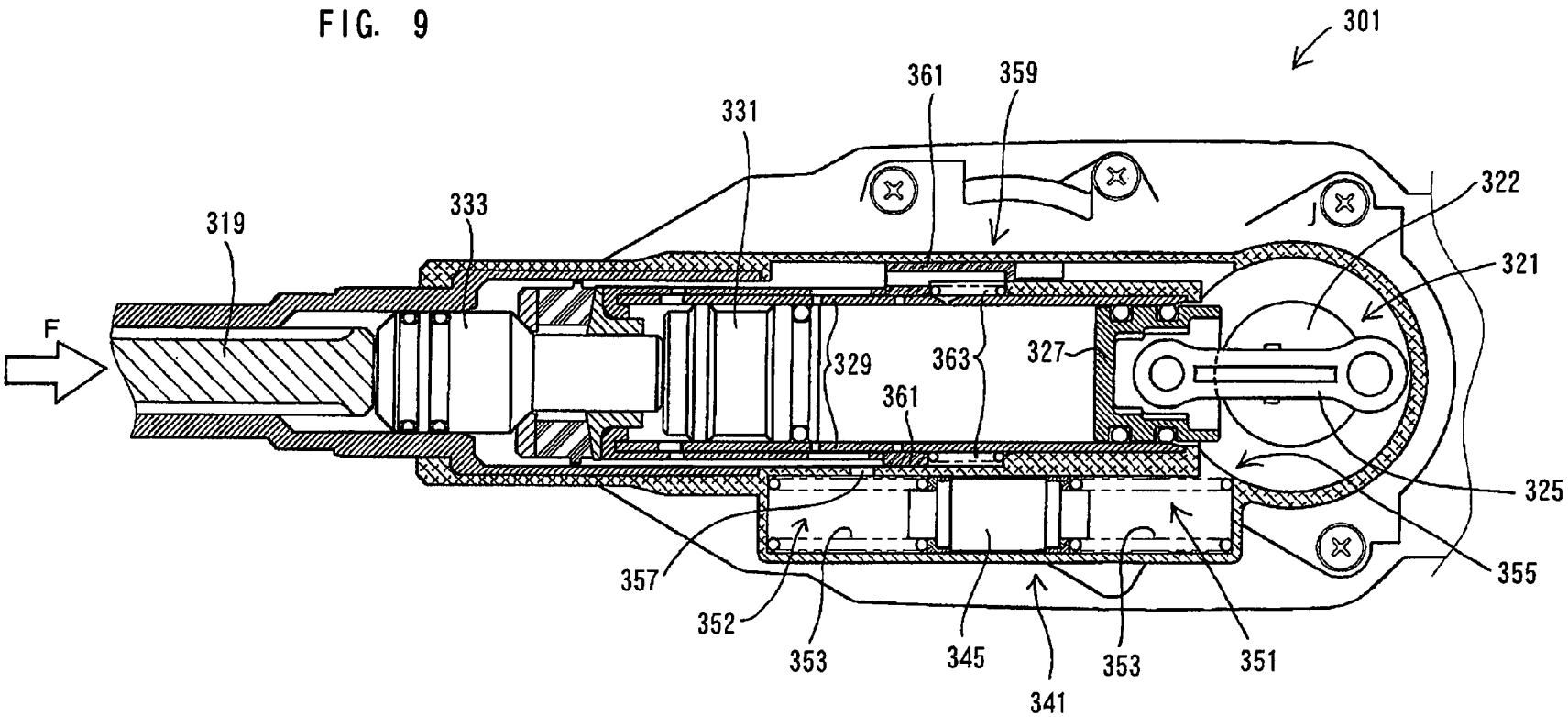
FIG. 9 also shows the essential part of the electric hammer of the third embodiment under loaded driving conditions.

As shown in FIG. 9, in a hammering operation on the workpiece by using the hammer 301, when the user presses the hammer 301, a load from the workpiece side (reaction force against the pressing force) F is applied to the hammer bit 319. Such state is defined as loaded driving conditions. Under the loaded driving conditions, the actuating element 361 slides along the cylinder 329 away from the hammer bit 319 against the biasing force of the biasing spring 363 by the pressing force applied by the user to the hammer 301. Then, the actuating element 361 opens the second communicating portion 357 which has been held closed under the unloaded driving conditions, and closes the third communicating portion 359 which has been held opened. As a result, the crank chamber 321 is prevented from communicating with the outside and is brought in communication with the first actuation chamber 351 of the dynamic vibration reducer 341 via the first communicating portion 355.

In this state, a driving gear 322 rotates and a driver 327 reciprocates via a crank arm 325. Then, a striker 331 reciprocates and transmits the impact force to the hammer bit 319 via an impact bolt 333. Thus, the hammer 301 is driven under the loaded driving conditions. At this time, when the capacity and thus the pressure within the crank chamber 321 fluctuates, such fluctuating pressure acts on the first actuation chamber 351 via the first communicating portion 355. As a result, the weight 345 is caused to reciprocate in a direction opposite to the reciprocating direction of the striker 331, so that the vibration of the hammer 301 can be effectively reduced.

When the weight 345 is forcedly and actively driven by utilizing pressure fluctuations of the crank chamber 321 under the loaded driving conditions, the second actuation chamber 352 is opened to the outside via the second communicating portion 357. Thus, the driving movement of the weight 345 is effectively prevented from being interfered by adiabatic expansion or compression within the second actuation chamber 352. The other components or elements in the third embodiment are substantially identical to those in the first embodiment and thus will not be described in detail.

In the second and third embodiments, the weight 245 (345) of the dynamic vibration reducer 241 (341) is drivingly controlled by achieving communication or non-communication between the crank chamber 221 (321) and the outside, the crank chamber 221 (321) and the first actuation chamber 251 (351), and the second actuation chamber 252 (352) and the outside. However, it may be constructed such that the weight 245 (345) is drivingly controlled by utilizing any one of these elements.

Fourth Embodiment

Figure 10:
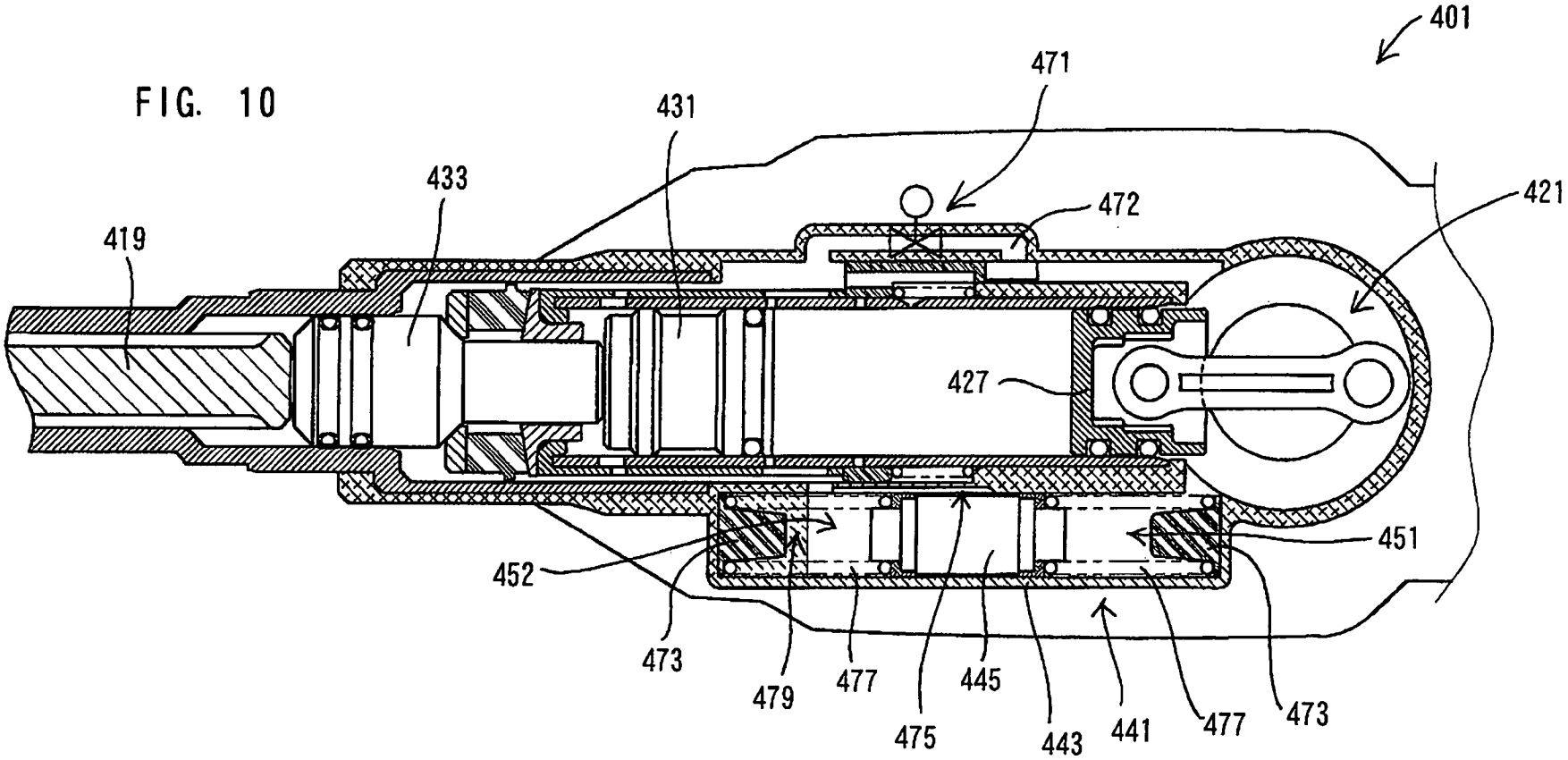
FIG. 10 shows an essential part of an electric hammer of a fourth embodiment of the invention.

A fourth embodiment of the present invention will now be described with reference to FIG. 10. In the fourth embodiments, various modifications are made in order to improve the performance of the above embodiments. In FIG. 10, a hammer 401 is shown as an example of improvement from the hammer 301 (see FIG. 9) according to the third embodiment under the loaded driving conditions. In the hammer 401, characteristic elements, such as a pressure regulating valve 471, an elastic member 473, an actuation chamber communicating portion 475, a spring 477 having a non-steady spring constant, and an air cushion region 479, are additionally provided. These features can also be applied to the hammers 101, 201 according to the other embodiments.

The pressure regulating valve 471 is disposed in the passage 472 from the crank chamber 421 to the outside. When the weight 445 of the dynamic vibration reducer 441 is actively driven by utilizing pressure fluctuations of the crank chamber 421, the pressure regulating valve 471 appropriately releases the pressure within the crank chamber 421 to the outside. In this manner, the pressure regulating valve 471 regulates the pressure applied to the first actuation chamber 451 (the pressure applied to the weight 445) and adjusts the driving speed and driving amount of the weight 445.

The elastic member 473 is disposed in each of the end portions of the first actuation chamber 451 and the second actuation chamber 452. The elastic member 473 thus prevents the weight 445 from colliding with the end of the cylindrical body 443 of the dynamic vibration reducer 441 and thus adversely affecting the durability of the dynamic vibration reducer 441 when the stroke of the reciprocating weight 445 reciprocating in a direction opposite to the reciprocating direction of the striker 431 excessively increases. The elastic member 473 also prevents the spring 477 from buckling due to excessively large strokes.

The actuation chamber communicating portion 475 extends a predetermined distance from the second actuation chamber 452 side to the first actuation chamber 451 side in the inner wall of the cylindrical body 441. The communicating portion 475 has a diameter larger than the weight 445 and thus forms a large-diameter region in which a clearance can be defined between the weight 445 and the cylindrical body 441. When the stroke of the reciprocating weight 445 in the cylindrical body 441 is within a predetermined range, the communicating portion 475 isolates the first actuation chamber 451 from the second actuation chamber 452. When the stroke of the reciprocating weight 445 excessively increases beyond the predetermined range, the communicating portion 475 communicates the first actuation chamber 451 with the second actuation chamber 452 when the entire length of the weight 445 is located in a position of the region of the communicating portion 475. Thus, when the stroke of the weight 445 excessively increases, the pressure within the first actuation chamber 451 is appropriately released into the second actuation chamber 452, so that the stroke of the weight 445 can be reduced and the vibration reducing performance can be optimized.

The spring 477 having a non-steady spring constant is configured such that its biasing force acting in a direction opposite to the reciprocating direction of the weight 445 increases relatively when the stroke of the weight 455 excessively increases. Specifically, the spring 477 is configured to have a non-steady spring constant such that the spring constant increases relatively when the spring 477 moves away from the weight 445. For example, a spring with non-uniform pitches or a conical spring can be used.

The air cushion region 479, like the elastic member 473, is selectively disposed in the end portions of the first actuation chamber 451 and the second actuation chamber 452 in order to prevent the weight 445 from adversely affecting the cylindrical body 443 or the spring 477 when the stroke of the reciprocating weight 445 excessively increases.

Fifth Embodiment

Figure 11:
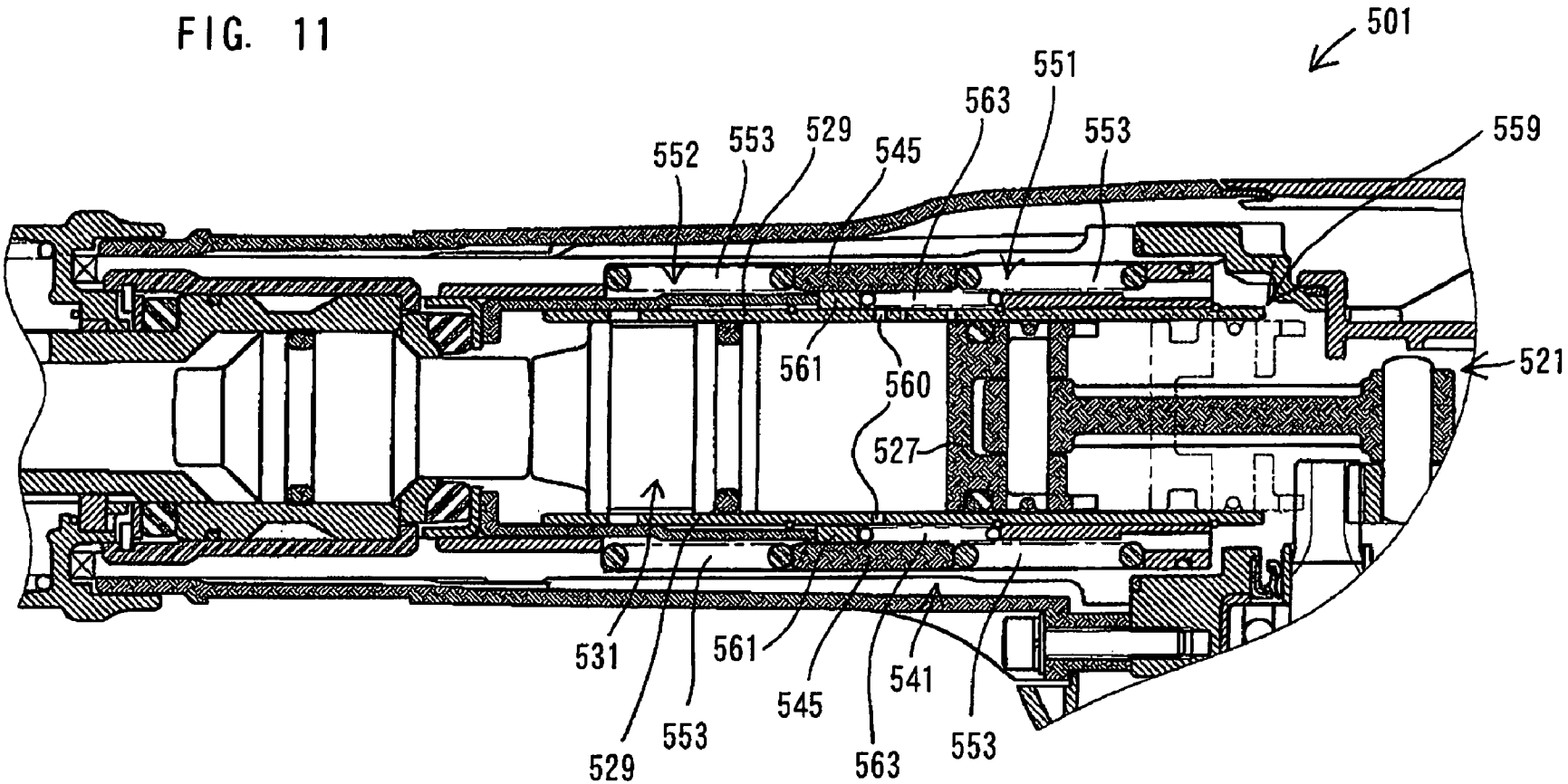
FIG. 11 shows an essential part of an electric hammer of a fifth embodiment of the invention under unloaded driving conditions.

A fifth embodiment of the present invention will now be described with reference to FIGS. 11 and 12. In a hammer 501 according to this embodiment, a weight 545 of a dynamic vibration reducer 541 and a biasing spring 553 that applies a biasing force to the weight 545 are cylindrically formed and disposed so as to define the first actuation chamber 551 and the second actuation chamber 552 along the outer circumferential surface of the cylinder 529 while separating them from each other. The first actuation chamber 551 is always in communication with a crank chamber 521 via a first communicating portion 559. The weight 545 can slide in the axial direction of the hammer bit 519 (shown in FIG. 12 only) along the cylinder 529 while receiving the biasing force of the biasing spring 553.

A cylindrical actuating element 561 and a biasing spring 563 that biases the actuating element 561 are disposed between the cylinder 529 and the weight 545. In FIG. 11, the hammer 501 is shown under the unloaded driving conditions in which no load is applied from the side of the workpiece (not shown) to the hammer bit 519. At this time, the actuating element 561 is biased leftward as viewed in the drawing by the biasing spring 563. In this state, the actuating element 561 opens a second communicating portion 560 that communicates the first actuation chamber 551 with the outside (a compression chamber defined between a driver 527 and a striker 531).

As a result, under the unloaded driving conditions, the pressure within the crank chamber 521 is led into the first actuation chamber 551 through the first communicating portion 559 and then into the compression chamber between the driver 527 and the striker 531 through the second communicating portion 560 and thus released to the outside. Therefore, the weight 545 is not actively driven by utilizing pressure fluctuations within the crank chamber 521. Thus, under the unloaded driving conditions, in which vibration reduction is not so highly required, the weight 545 is prevented from being carelessly driven actively and thus causing vibration of the hammer 501. Further, the dynamic vibration reducer 541 functions as an inherently passive vibration reducing mechanism according to the vibration inputted from the outside (the hammer 501).

Figure 12:
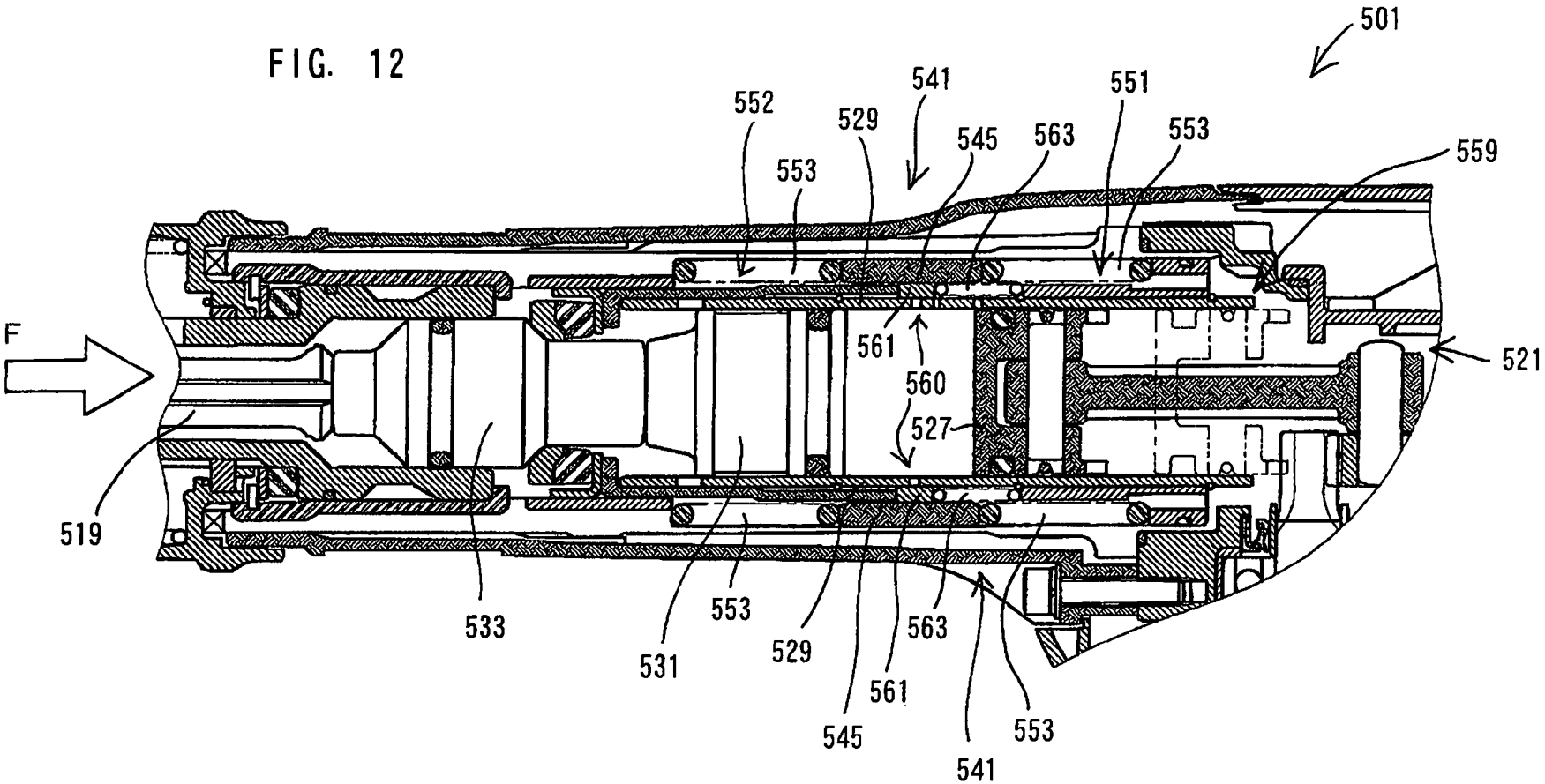
FIG. 12 shows an essential part of an electric hammer of the fifth embodiment under loaded driving conditions.

As shown in FIG. 12, in a hammering operation on the workpiece by using the hammer 501, when the user presses the hammer 501, a load from the workpiece side (reaction force against the pressing force) F is applied to the hammer bit 519. Such state is defined as loaded driving conditions. Under the loaded driving conditions, the actuating element 561 slides along the cylinder 529 away from the hammer bit 519 against the biasing force of the biasing spring 563 by the pressing force applied by the user to the hammer 501. Then, the actuating element 561 closes the second communicating portion 560 which has been held opened under the unloaded driving conditions. As a result, communication of the crank chamber 521 and the first actuation chamber 551 with the outside is interrupted.

In this state, when the driver 527 reciprocates, the striker 531 reciprocates and transmits the impact force to the hammer bit 519 via an impact bolt 533. Thus, the hammer 501 is driven under the loaded driving conditions. At this time, when the capacity and thus the pressure within the crank chamber 521 fluctuates, such fluctuating pressure acts on the first actuation chamber 551 via the first communicating portion 559. As a result, the weight 545 is caused to reciprocate in a direction opposite to the reciprocating direction of the striker 531, thereby effectively performing a vibration reducing function.

In this embodiment, the weight 545 of the dynamic vibration reducer 541 is cylindrically formed and disposed along the circumferential surface of the cylinder 529, and the weight 545 is caused to reciprocate sliding along the cylinder 529. With this construction, the space required for installing the dynamic vibration reducer 541 in the hammer 501 can be minimized, so that miniaturization of the hammer can be achieved.

In the dynamic vibration reducer 141 (241, 341, 441, 541), the vibration reducing mechanism is formed from the weight 145 (245, 345, 445, 545) and the biasing spring 153 (253, 353, 453, 553). However, it may be constructed such that not only a spring force of a spring element but a damping force may preferably be applied, for example, by charging oil into the region on the both sides of the weight.

Sixth Embodiment

Figure 13:
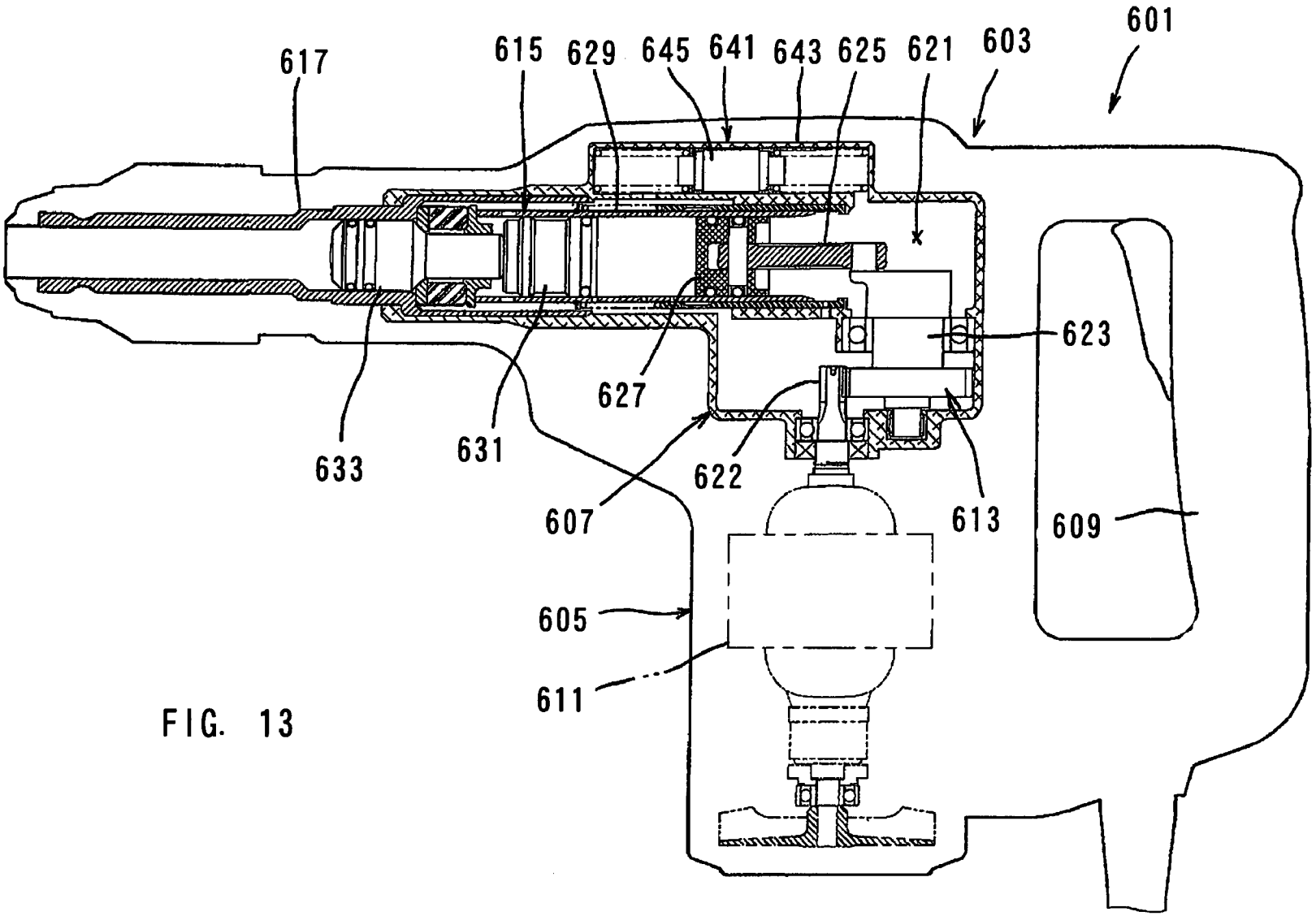
FIG. 13 is a sectional side view showing an entire hammer according to a sixth embodiment of the invention.
Figure 14:
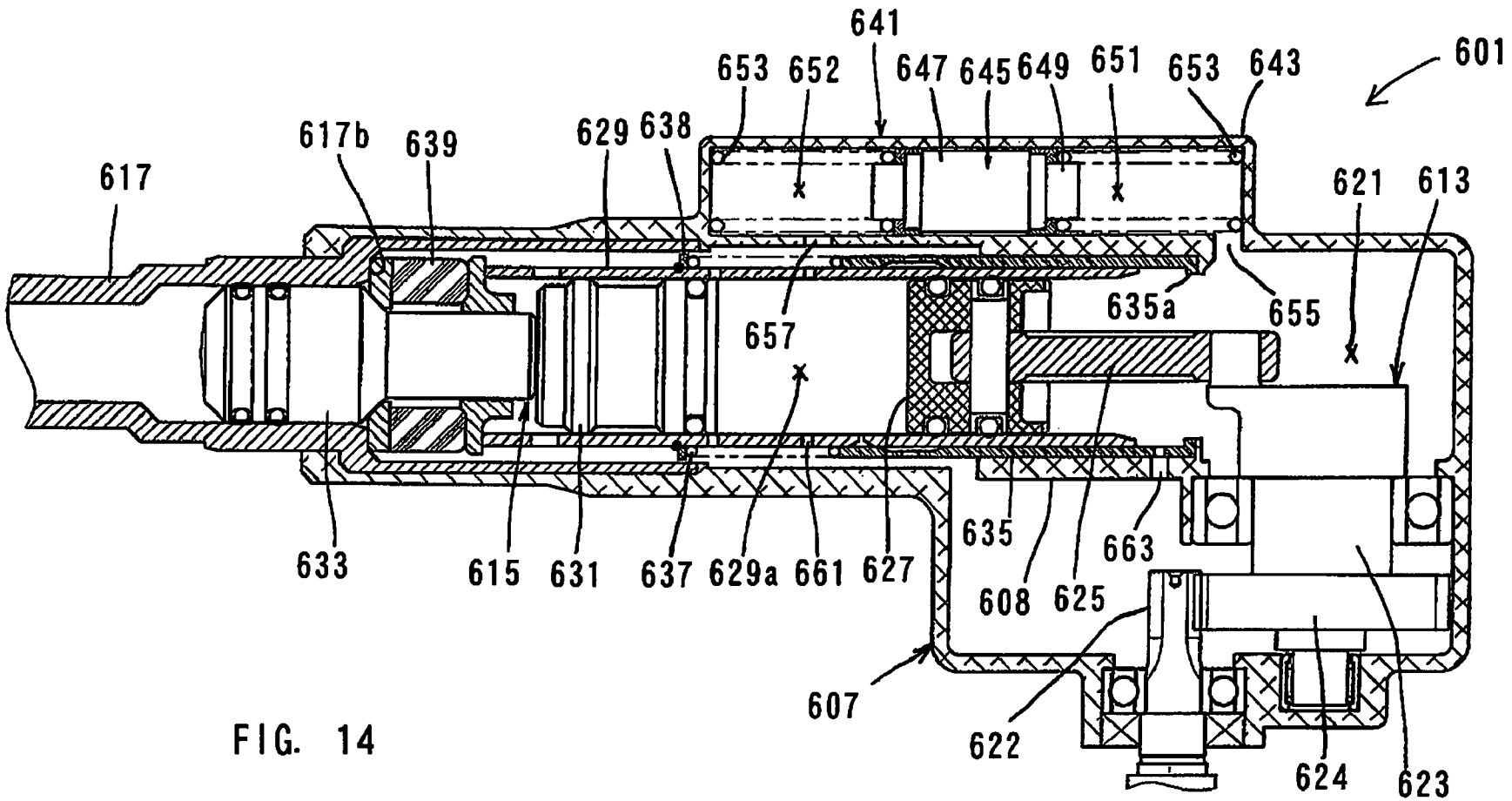
FIG. 14 is a sectional side view of an essential part of the entire hammer of the sixth embodiment under unloaded driving conditions.
Figure 15:
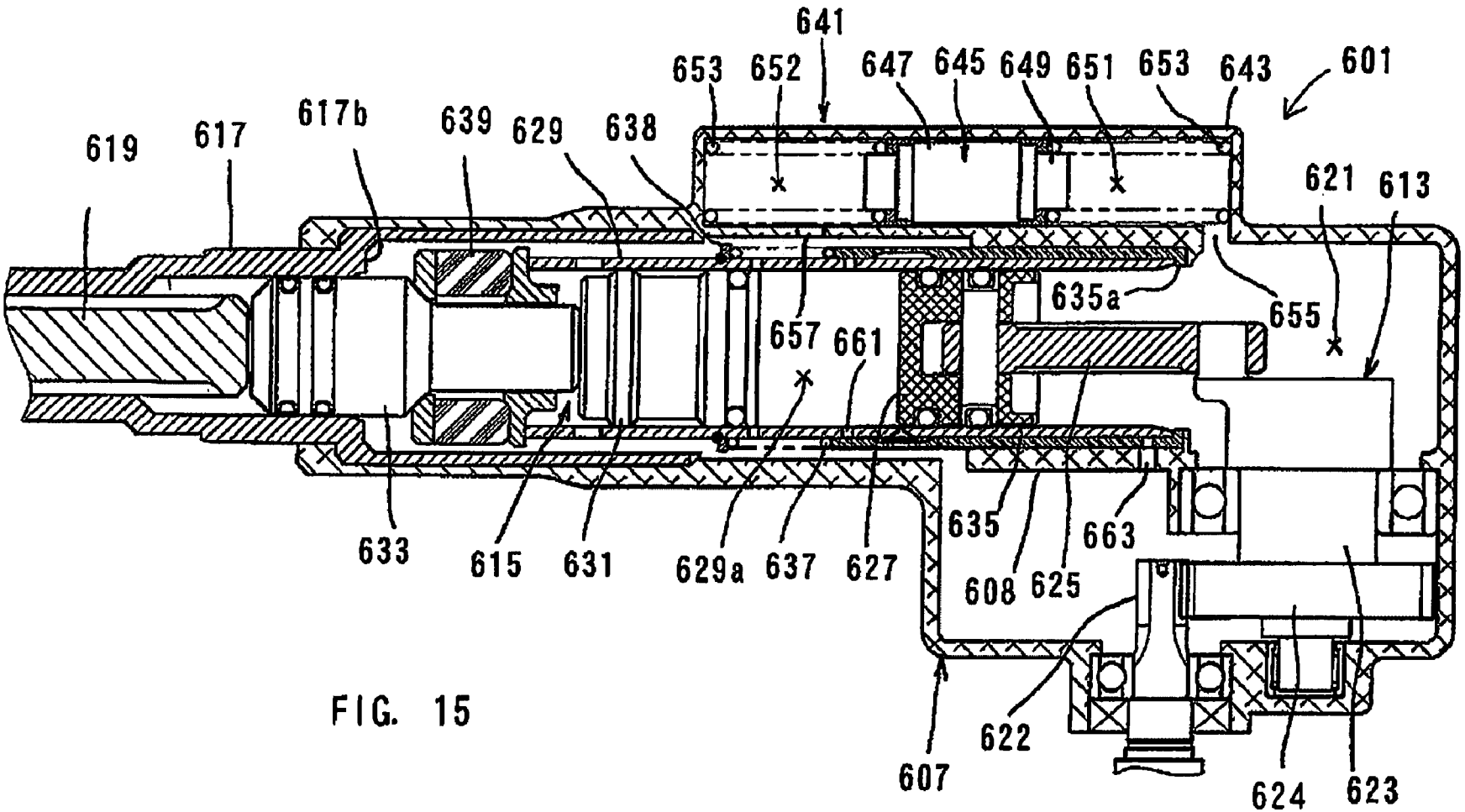
FIG. 15 is a sectional side view of an essential part of the entire hammer of the sixth embodiment under loaded driving conditions.

A sixth embodiment of the present invention will now be described with reference to FIGS. 13 to 15. Within the sixth representative hammer 601, the eccentric shaft 623 is eccentrically disposed in a position displaced from the center of rotation of the driving gear 622. The eccentric shaft 623 has a driven gear 624 that engages with the driving gear 622. One end of the crank arm 625 is loosely connected to the eccentric shaft 623 and the other end is loosely connected to a driver (piston) 627. The driving gear 622, the eccentric shaft 623 and the crank arm 625 are disposed within a crank chamber 621.

The driver 627 and the striker 631 are slidably disposed within the cylinder 629. The cylinder 629 can move in its axial direction (the axial direction of the hammer bit 619) via a cylindrical cylinder guide 635 that is fitted into a barrel 608 of the gear housing 607. The cylinder 629 is always urged toward the tool holder 617 by a pressure spring 637. The pressure spring 637 is disposed between the front end of the cylinder guide 635 and a spring receiver 638 that is formed on the cylinder 629 around its circumferential surface.

Thus, under unloaded driving conditions in which the hammer 601 is not pressed against the workpiece, or in which a load associated with the hammering operation is not applied to the hammer bit 619, the cylinder 629 is caused to move forward toward the tool holder 617. Then, as shown in FIG. 14, the cylinder 629 abuts on a stepped surface 617*b* of the tool holder 617 via a cushioning material in the form of a cushion rubber 639 and retained in the forward position.

Under loaded driving conditions, when the hammer bit 619 is retracted (moved rightward as viewed in the drawings), the cylinder 629 is caused to move rearward away from the tool holder 617 via the impact bolt 633 and the cushion rubber 639. Then, the cylinder 629 abuts on a stopper 635*a* formed on the axial rear end of the cylinder guide 635 and retained in the rearward position. Thus, the cylinder 629 can move between the forward position near the tool holder 617 and the rearward position remote from the tool holder 617. The forward position and the rearward position correspond to the "first position" and the "second position" according to the present invention.

Air spring chamber 629*a* (air compression space) is defined in the cylinder 629 between the driver 627 and the striker 631. The air spring chamber 629*a* can communicate with the outside via an air vent 661. The air vent 661 is formed through the cylinder 629 and serves to prevent idle hammering. Under the unloaded driving conditions, the air vent 661 is opened so as to communicate the air spring chamber 629*a* with the outside (air). While, under the loaded driving conditions in which the cylinder 629 is in the rearward position remote from the tool holder 617, the air vent 661 is closed by the cylinder guide 635 fitted around the cylinder 629, thus preventing the air spring chamber 629*a* from communicating with the outside.

The crank chamber 621 can communicate with the outside via an air vent 663. The air vent 663 is formed through the barrel 608 and the cylinder guide 635 and serves to control the forced vibration of the dynamic reducer 641. Under the unloaded driving conditions in which the cylinder 629 is in the forward position near the tool holder 617, the air vent 663 is opened so as to communicate the crank chamber 621 with the outside. While, under the loaded driving conditions in which the cylinder 629 is in the rearward position remote from the tool holder 617, the air vent 663 is closed by the cylinder 629, thus preventing the crank chamber 621 from communicating with the outside.

Operation of the hammer 601 constructed as described above will now be explained. First, operation of the hammer 601 under loaded driving conditions will be explained. The user presses the hammer 601 against the workpiece in order to perform a hammering operation on a workpiece (not shown) so that a load is applied from the workpiece side to the hammer bit 619.

When the driving motor 611 (shown in FIG. 13) is driven, the rotating output of the driving motor 611 causes the driving gear 622 to rotate in the horizontal plane. When the driving gear 622 rotate, the eccentric shaft 623, which has a driven gear 624 that engages with the driving gear 622, revolves in the horizontal plane, which in turn causes the crank arm 625 to swing in the horizontal plane. The driver 627 on the end of the crank arm 625 then slidingly reciprocates within the bore of the cylinder 629.

In this state, when the hammer 601 is pressed against the workpiece, the hammer bit 619 is retracted by the workpiece, which in turn causes the cylinder 629 to move rearward away from the tool holder 617 via the impact bolt 633 and the cushion rubber 639 against the biasing force of the pressure spring 637. When the cylinder 629 moves to the rearward position, as shown in FIG. 15, the air vent 661 of the cylinder 629 is closed by the cylinder guide 635. At the same time, the air vent 663 of the crank chamber 621 is also closed by the cylinder 629. The driver 627 slides forward relative to the rearward movement of the cylinder 629, thereby compressing air within the air spring chamber 629*a* defined by a space between the driver 627 and the striker 631. The striker 631 reciprocates within the cylinder 629 and collides with the impact bolt 633 at a speed higher than the driver 627 by the action of the air spring function as a result of the air compression. The kinetic energy of the striker 631 which is caused by the collision with the impact bolt 633 is transmitted to the hammer bit 619. Thus, the hammering operation is performed on a workpiece (not shown).

The dynamic vibration reducer 641 on the body 603 serves to reduce impulsive and cyclic vibration caused when the hammer bit 619 is driven as mentioned above. Specifically, the weight 647 and the biasing springs 653 cooperate to passively reduce vibration of the body 603 on which a predetermined outside force (vibration) is exerted. Thus, the vibration of the hammer 601 of this embodiment can be effectively alleviated or reduced.

In this embodiment, when the hammer 601 is driven, the capacity within the crank chamber 621 changes as the driver 627 reciprocates in the axial direction of the hammer bit 619 within the cylinder 629. For example, when the driver 627 moves toward the hammer bit 619 (forward), a force acts on the striker 631 in a direction toward the hammer bit 619 by the action of the air spring function between the striker 631 and the driver 627. At this time, the capacity within the crank chamber 621 increases and the pressure within the crank chamber 621 reduces as the driver 627 slides toward the hammer bit 619. The reduced pressure acts on the first actuation chamber 651 of the dynamic vibration reducer 641 via the communicating portion 655. As a result, a force acts on the weight 645 in a direction away from the hammer bit 619.

When the driver 627 further slides toward the hammer bit 619 until it reaches a compression side dead point (forward end). At this time, the striker 631 moves toward the hammer bit 619 and collides with the impact bolt 633 by the continuous action of the air spring function. As a result, the impulsive striking force is transmitted to the hammer bit 619, and the hammer bit 619 reciprocates within the tool holder 617 and thus, performs a hammering operation.

At this time, the pressure within the crank chamber 621 which has been reduced due to increase of the capacity within the crank chamber 621 is continuously applied to the inside of the first actuation chamber 651. Thus, the force (pulling force) continuously acts on the weight 645 in a direction away from the hammer bit 619. As a result, the weight 645 slides rearward (rightward as viewed in the drawing). Thus, under the loaded driving conditions of the hammer 601, the dynamic vibration reducer 641 not only serves as a passive vibration reducing mechanism, but serves as an active reducing mechanism for reducing vibration by forced vibration in which the weight 645 is actively driven by utilizing the pressure fluctuations within the crank chamber 621.

Further, when the weight 645 moves linearly in a direction opposite to the moving direction of the striker 631, outside air is introduced into the second actuation chamber 652 via the second communicating portion 657 of the second actuation chamber 652. Thus, in this embodiment, the linear movement of the weight 645 is effectively prevented from being interfered by the inside space of the second actuation chamber 652 being expanded in a state in which outside air cannot be introduced (adiabatic expansion) when the weight 645 moves rightward as viewed in the drawing.

When the driving gear 622 is further rotated from the state in which the driver 627 is located at the compression side dead point (forward end), the driver 627 moves away from the hammer bit 619. As a result, a force (pulling force) acts on the striker 631 in the direction away from the hammer bit 619 by the air spring acting on the expansion side. At this time, as the capacity within the crank chamber 621 reduces and the pressure within the crank chamber 621 increases, a force (pressing force) acts on the weight 645 of the dynamic vibration reducer 641 in the direction toward the hammer bit 619 by the action of the fluctuating pressure that is applied to the first actuation chamber 651 via the communicating portion 655.

As described above, due to the time required for actuation of the air spring, the inertial force of the striker 631 or other similar factors, the striker 631 starts to move linearly with a slight time delay after the driver 627 starts to move away from the hammer bit 619. As a result, in the process in which the driver 627 moves to the non-compression dead point (rearward end), the striker 631 starts the linear movement in a direction away from the hammer bit 619. At the same time, the weight 645 of the dynamic vibration reducer 641 starts the linear movement in a direction opposite to the direction of the linear movement of the striker 631. As a result, even when the striker 631 retracts, the vibration reducing mechanism effectively functions by actively driving the weight 645.

When the weight 645 moves linearly leftward as viewed in the drawing, outside air is introduced into the second actuation chamber 652 via the second communicating portion 657. Thus, in this embodiment, the linear movement of the weight 645 is not interfered by the inside space of the second actuation chamber 652 being compressed in a state in which outside air cannot be introduced (adiabatic compression) when the weight 645 moves leftward as viewed in the drawing.

Next, operation of the hammer 601 under unloaded driving conditions will be explained, in which no load is applied from the workpiece side to the hammer bit 619, or in which the hammer 601 (the hammer bit 619) is not pressed against the workpiece. Under the unloaded driving conditions, the cylinder 629 is moved to the forward position near the tool holder 617 by the pressure spring 637, and the air vent 661 of the air spring chamber 629*a* and the air vent 663 of the crank chamber 621 are opened.

In this state, even if the driving motor 611 is driven and the driver 627 is moved forward via the driving gear 622, the driven gear 624, the eccentric shaft 623 and the crank arm 625, air within the air spring chamber 629*a* is not compressed because the air spring chamber 629*a* communicates with the outside through the air vent 661. As a result, the striker 631 is not driven. Specifically, the driver 627 runs at idle, so that the hammer bit 619 is prevented from idle hammering. Further, because the crank chamber 621 also communicates with the outside through the air vent 663, the pressure within the crank chamber 621 does not fluctuate even if the driver 627 moves forward. Therefore, the weight 645 is not actively driven by utilizing the pressure fluctuations within the crank chamber 621. Therefore, the dynamic vibration reducer 641 does not serve as an active mechanism for reducing vibration by forced vibration, but only serves as a passive mechanism for reducing vibration. Thus, under the unloaded driving conditions, the weight 645 is prevented from causing vibration to the hammer 601.

According to this embodiment, the dynamic vibration reducer 641 can be switched between the forced vibration state and the forced-vibration disabled state depending on whether under loaded driving conditions or unloaded driving conditions, so that it can perform a vibration reducing function according to the driving conditions of the hammer 601. Such switching control between the forced vibration state and the forced-vibration disabled state is achieved by the movement of the already-existing cylinder 629 that comprises a component part of the hammer 601. Thus, the number of parts can be reduced and the construction can be made simpler.

Further, in the present embodiment, with the construction in which the cylinder 629 opens and closes the air vent 663 of the crank chamber 621, the cylinder 629 and the circumferential portion around the cylinder on which the cylinder 629 slides can form a sealing surface region. As a result, satisfactory sealing can be ensured, so that the effectiveness of the forced vibration of the dynamic vibration reducer 641 can be enhanced. Further, with the construction in which the crank chamber 621 communicates with the outside under the unloaded driving conditions, pressure fluctuations within the crank chamber 621, or particularly, resistance caused by pressure increase can be avoided. Thus, useless consumption of energy can be effectively prevented.

Seventh Embodiment

Figure 17:
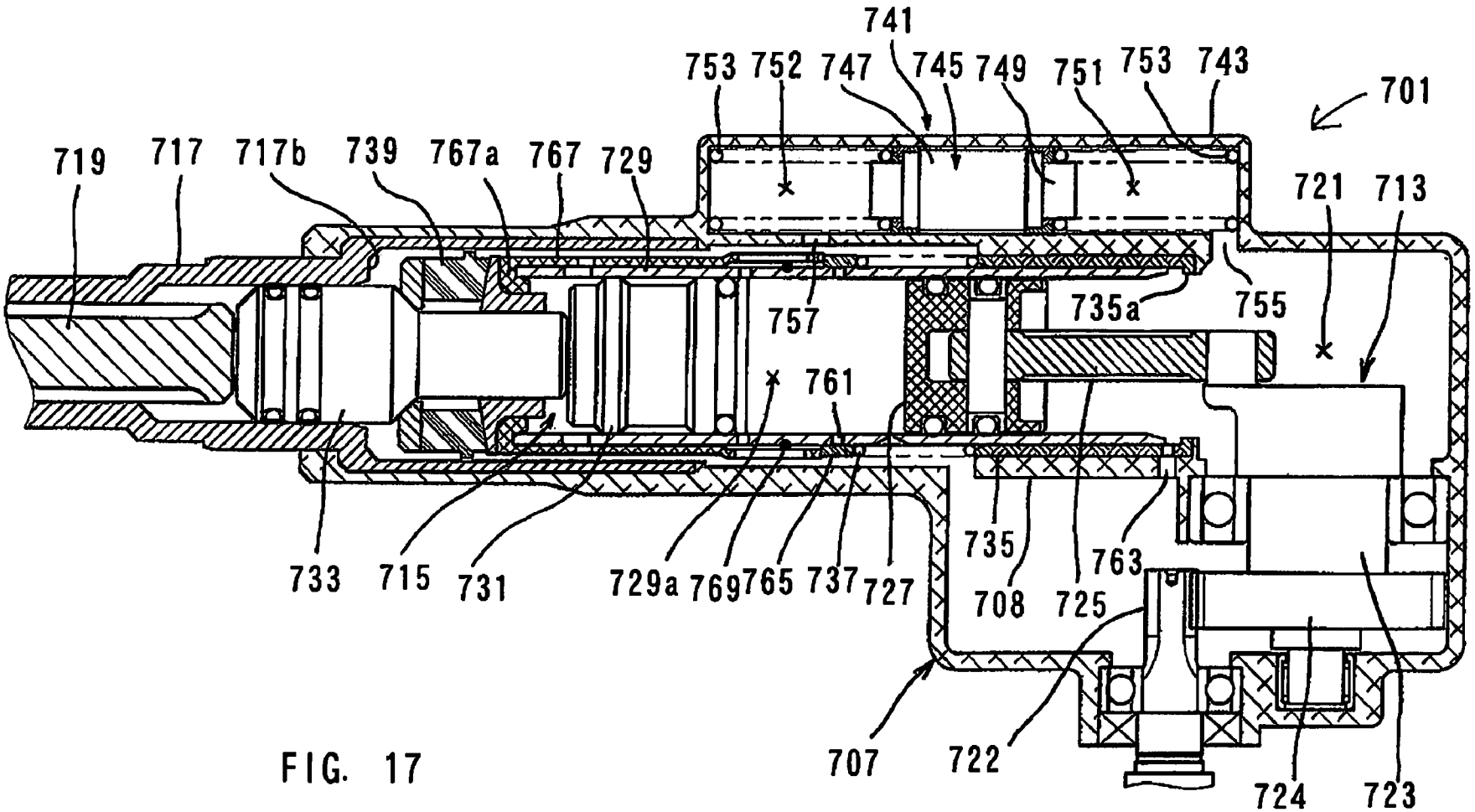
FIG. 17 is a sectional side view of an essential part of the entire hammer of the seventh embodiment, showing the state in which prevention of the idle hammering is disabled under loaded driving conditions.
Figure 18:
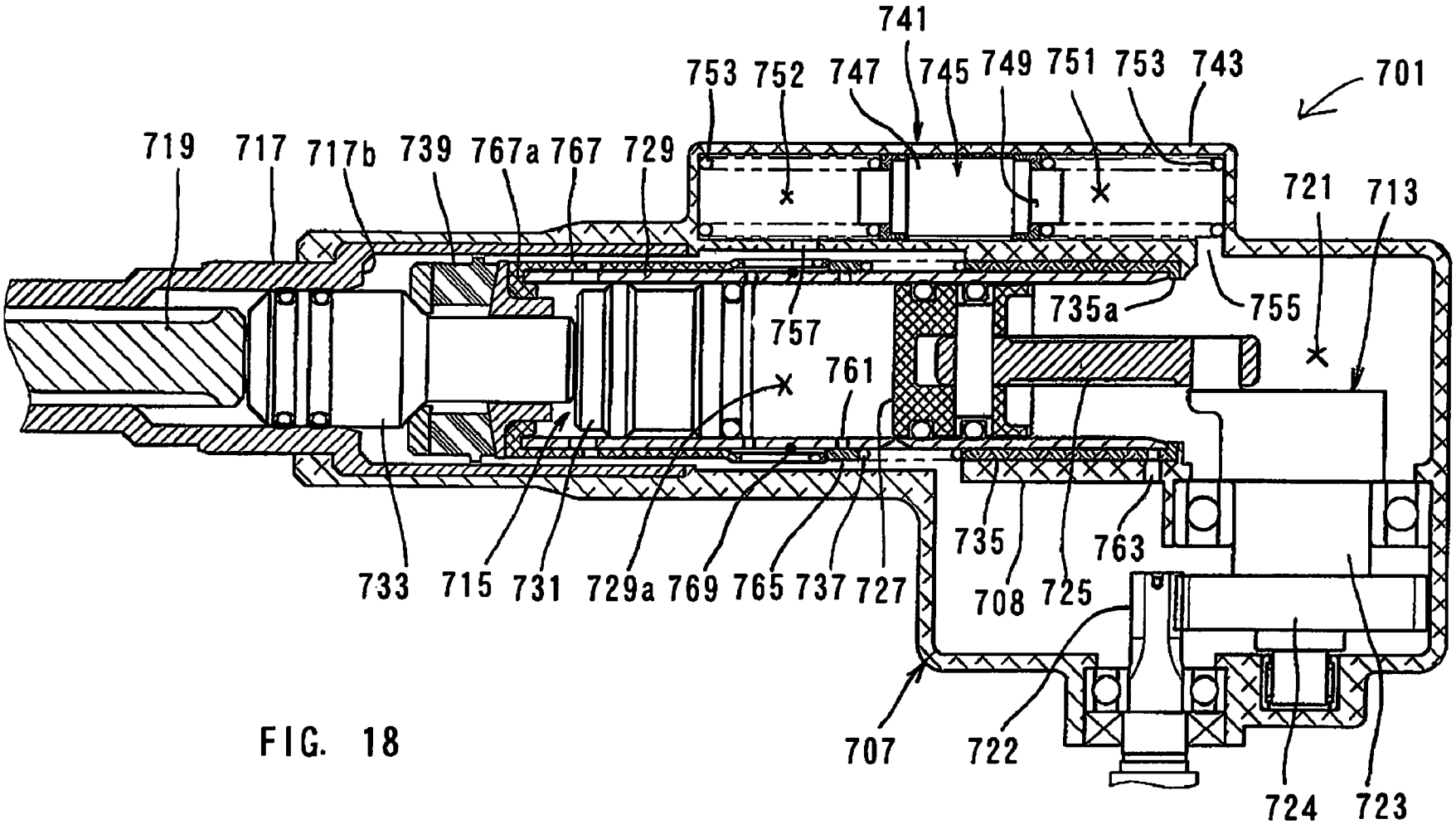
FIG. 18 is a sectional side view of an essential part of the entire hammer of the seventh embodiment under loaded driving conditions.

Seventh embodiment of the present invention will now be described with reference to FIGS. 16 to 18. In the seventh embodiment, the forced vibration of the dynamic vibration reducer 741 (active driving of the weight 745) is performed with a predetermined time delay after the prevention of idle hammering is disabled when the hammer 701 is switched from the unloaded driving conditions to the loaded driving conditions.

In this embodiment, in addition to the construction described with respect to the first embodiment, the hammer further includes a movable ring 765 and a sleeve 767. The movable ring 765 is fitted around the cylinder 729 and serves to open and close the air vent 761 for the air spring chamber 729*a*. The movable ring 765 is disposed between the sleeve 767 and the cylinder guide 135. The sleeve 767 is fitted around the front portion of the cylinder 729 (on the side of the hammer bit 719) such that it can move relative to the cylinder 729. One end of the sleeve 767 in its axial direction (the axial direction of the hammer bit 719) is in contact or fixed with the cushion rubber 739. The pressure spring 737 is disposed between the cylinder guide 735 and the sleeve 767 and applies a biasing force to the movable ring 765 so as to move it forward toward the sleeve 767. Further, the biasing force of the pressure spring 737 presses a stopper 769 that is fixedly mounted around the cylinder 729, via the movable ring 765, and moves the cylinder 729 forward.

Figure 16:
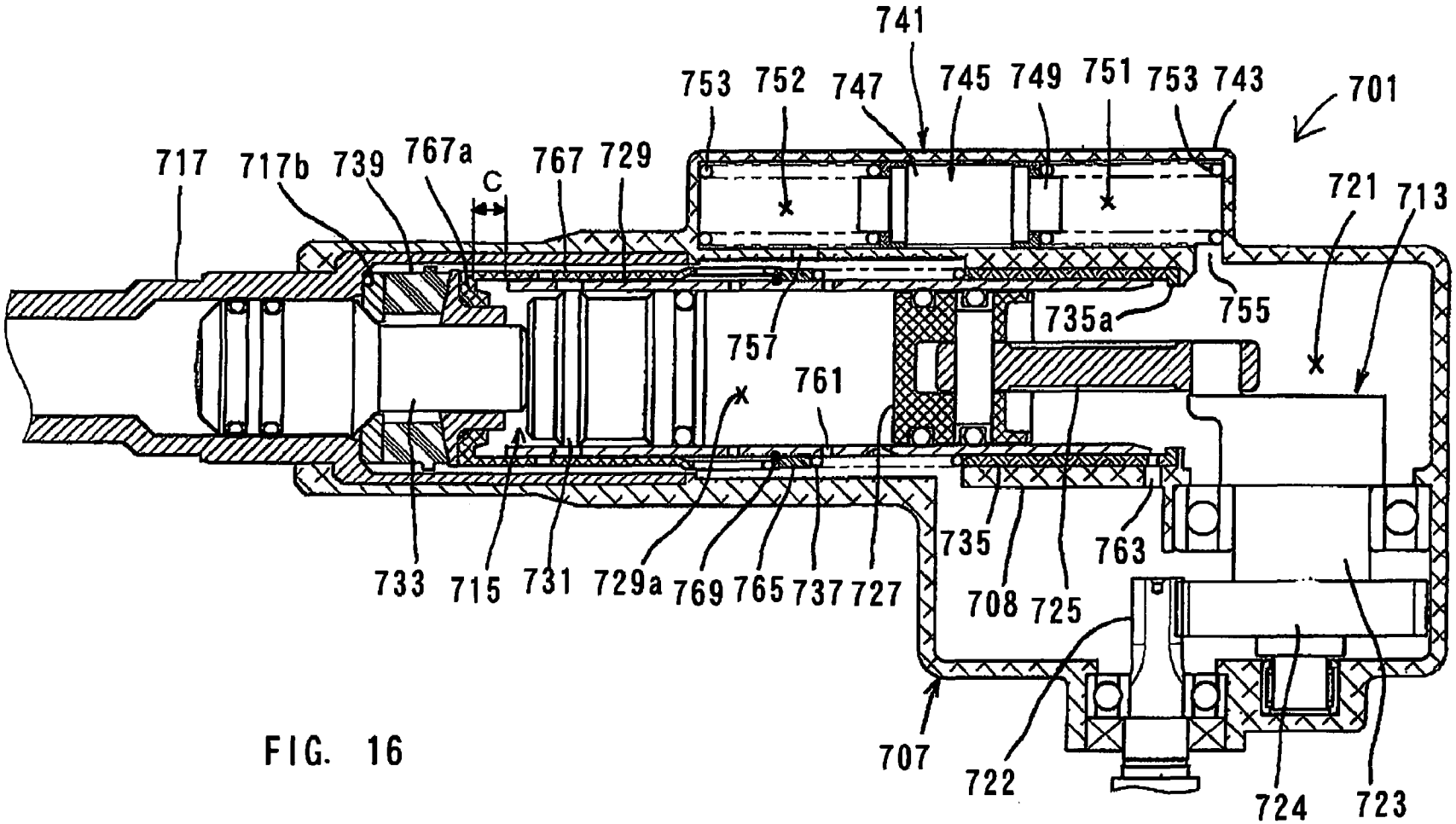
FIG. 16 is a sectional side view showing an entire hammer according to a seventh embodiment of the invention.

FIG. 16 shows the unloaded driving conditions in which the hammer bit 719 is not pressed against the workpiece. Under the unloaded driving conditions, the movable ring 765 is moved forward near the tool holder 717 by the pressure spring 737 and held in contact with the stepped surface 717*b* of the tool holder 717 via the sleeve 767 and the cushion rubber 739. Further, the cylinder 729 is also moved to and held in the forward position near the tool holder 717 via the movable ring 765 and the stopper 769 by means of the pressure spring 737. At this time, the front end of the cylinder 729 in the forward position is oppositely positioned at a predetermined distance C (see FIG. 16) from an annular cylinder receiving portion 767*a* formed in the front end of the sleeve 767. When the ring 765 moves to the forward position, the air vent 761 for the air spring chamber 729*a* is opened and the air spring chamber 729*a* communicates with the outside. Further, when the cylinder 729 moves to the forward position, the air vent 763 for the crank chamber 721 is opened and the crank chamber 721 communicates with the outside.

Therefore, even if the driving motor 711 is driven under the unloaded driving conditions and the driver 727 moves forward (to the hammer bit 719 side) via the driving gear 722, the driven gear 724, the eccentric shaft 723 and the crank arm 725, air within the air spring chamber 729*a* is not compressed because the air spring chamber 729*a* communicates with the outside through the air vent 761. Therefore, the air spring function is not performed on the striker 731 and the striker 731 is not driven. Thus, the hammer bit 719 is prevented from idle hammering.

Further, because the crank chamber 721 also communicates with the outside through the air vent 763, the pressure within the crank chamber 721 is not changed even if the driver 727 moves forward. Therefore, the weight 745 is not actively driven by utilizing the pressure fluctuations within the crank chamber 721. Thus, under the unloaded driving conditions, in which vibration reduction is not so highly required, the weight 745 is prevented from causing vibration of the hammer which may be caused if the weight 745 is forcedly vibrated.

Under loaded driving conditions in which a load associated with the hammering operation is applied to the tool bit 719, when the hammer bit 719 is retracted (moved rightward as viewed in the drawings) by pressing against the workpiece, the movable ring 765 is caused to move rearward away from the tool holder 717 against the biasing force of the pressure spring 737 via the impact bolt 733, the cushion rubber 739 and the sleeve 767. As shown in FIG. 17, on its way to the rearward position, the movable ring 765 closes the air vent 761 of the air spring chamber 729*a*, thereby interrupting communication of the spring chamber 729*a* with the outside and disabling the function of preventing idle hammering. At the same time, the cylinder receiving portion 767*a* of the sleeve 767 abuts on the front end of the cylinder 729. In this stage, the air vent 763 of the crank chamber 721 is still held opened, and the prevention of idle hammering is disabled by the movable ring 765 prior to the forced vibration.

Thereafter, the movable ring 765 further moves rearward. With this rearward movement, as shown in FIG. 18, the cylinder 729 is pushed by the cylinder receiving portion 767*a* of the sleeve 767 and moves rearward away from the tool holder 717. At this time, the movable ring 765 and the cylinder 729 move together. Thus, the air vent 761 of the air spring chamber 729*a* is kept closed. With its rearward movement, the cylinder 729 closes the air vent 763 of the crank chamber 721 and interrupts communication of the crank chamber 721 with the outside, thereby allowing pressure fluctuation within the crank chamber 721. As a result, the dynamic vibration reducer 741 is switched to the forced vibration state in which the weight 745 of the dynamic vibration reducer 741 is actively driven by pressure fluctuations within the crank chamber 721. The cylinder 729 moves rearward until it stops at the rearward position in abutment with the stopper 735*a* of the cylinder guide 735. The function of the dynamic vibration reducer 741 reducing vibration by forced vibration is the same as the first embodiment, and thus will not be described.

The movable ring 765 and the cylinder 729 can move between the forward position near the hammer bit 719 and the rearward position remote from the hammer bit 719 with a predetermined time difference. The forward position and the rearward position correspond to the "first position" and the "second position", respectively, according to the present invention.

As described above, according to the seventh embodiment, under loaded driving conditions, the prevention of idle hammering is disabled prior to the forced vibration of the dynamic vibration reducer 741. In other words, the forced vibration of the dynamic vibration reducer 741 is performed with a predetermined time delay after the prevention of idle hammering is disabled. During operation of the hammer 701, after the pressure within the air spring chamber 729*a* starts to be compressed by forward movement of the driver 727, the striker 731 starts to move forward by the compressed pressure with a slight time delay (by the compression time required for the air spring to actually act on the striker 731), or the striker 731 starts to move linearly toward the hammer bit 719 with a slight time delay due to the inertial force of the striker 731 or other similar factors.

According to the seventh embodiment, the forced vibration of the dynamic vibration reducer 741 starts with a time delay after the prevention of idle hammering is disabled. With such construction, the weight 745 of the dynamic vibration reducer 741 can be controlled in the timing of its movement such that the weight 745 starts to move linearly in the direction opposite to the movement of the striker 731. In other words, the timing of the vibration reduction by the forced vibration of the weight 745 can be made to coincide with the timing of generation of vibration by the striking of the striker 731. As a result, the effectiveness of the vibration reduction can be enhanced. The other components or elements in the second embodiment which are substantially identical to those in the first embodiment are given like numerals as in the first embodiment and will not be described.

The seventh embodiment provides the technique for starting the forced vibration of the dynamic vibration reducer 741, under loaded driving conditions, with a time delay after the prevention of idle hammering of the hammer bit 719 is disabled. This technique can be applied to the sixth embodiment, for example, by adjusting the positions of the air vent 761 of the air spring chamber 729*a* and the air vent 763 of the crank chamber 721.

DESCRIPTION OF NUMERALS

101 electric hammer (power tool)
103 body
105 motor housing
107 gear housing
109 hand grip
111 driving motor
113 motion converting mechanism
115 striking mechanism
117 tool holder
119 hammer bit (tool bit)
121 crank chamber
122 driving gear
123 eccentric shaft
125 crank arm (crank mechanism)
127 driver (crank mechanism)
129 cylinder
129*a* air spring chamber
131 striker
133 impact bolt
141 dynamic vibration reducer
143 cylindrical body (body)
145 weight
147 large-diameter portion
149 small-diameter portion
151 first actuation chamber
152 second actuation chamber
153 biasing spring (elastic element)
155 first communicating portion
157 second communicating portion
261, 361, 561 actuating element
263, 363, 563 biasing spring
471 pressure regulating valve
473 cushion (elastic) member
475 actuation chamber communicating portion
477 spring having a non-steady spring constant
479 air cushion region
581 weight
583 biasing spring
635 cylinder guide
635*a* stopper
637 pressure spring
638 spring receiver
639 cushion rubber
661 air vent
663 air vent
665 movable ring
667 sleeve
667*a* cylinder receiving portion
669 stopper

The invention claimed is:

1. A power tool, comprising:

a tool bit;

a tool body to which the tool bit is coupled;

an actuating mechanism disposed in the tool body to drive the tool bit linearly by means of pressure fluctuations so as to cause the tool bit to perform a predetermined operation, wherein the actuating mechanism has a driving motor, a motion converting mechanism that converts a rotating output of the driving motor to a linear motion, a piston linearly reciprocating in a longitudinal direction of the tool bit via the motion converting mechanism, a striker disposed in front of the piston to cause the tool bit a linear motion, a first chamber between the striker and the piston, and a second chamber disposed adjacent to the piston within the tool body in an side of the first chamber; and a dynamic vibration reducer having a weight that reciprocates under a biasing force of an elastic element to reduce vibration of the actuating mechanism, the weight being driven by means of pressure fluctuations caused in the second chamber when the piston reciprocates, wherein the motion converting mechanism comprises a crank mechanism that drives the striker by converting a rotating output of the driving motor to a linear motion in an axial direction of the tool bit, and the second chamber is defined by a crank chamber that houses the crank mechanism.

2. The power tool as defined in claim 1, wherein, under loaded driving conditions, in which a load associated with the predetermined power tool operation is applied to the tool bit, the weight is allowed to be driven by means of fluctuating pressure developed in the second chamber, while, under unloaded driving conditions, in which a load associated with the predetermined power tool operation is not applied to the tool bit, the weight is prevented from being driven by means of fluctuating pressure developed in the second chamber.

3. The power tool as defined in claim 1, wherein, under loaded driving conditions, in which a load associated with the predetermined power tool operation is applied to the tool bit, the weight is allowed to be driven by means of fluctuating pressure developed in the second chamber, while, under unloaded driving conditions, in which a load associated with the predetermined power tool operation is not applied to the tool bit, the weight is prevented from being driven by means of fluctuating pressure developed in the second chamber and, wherein the dynamic vibration reducer includes a first actuating chamber and a second actuating chamber that are defined on opposite sides of the weight within the body, and wherein, at least under the loaded driving conditions, the fluctuating pressure developed in the second chamber is introduced into the first actuating chamber, and the second actuating chamber can communicate with the outside.

4. The power tool as defined in claim 1, wherein, under loaded driving conditions, in which a load associated with the predetermined power tool operation is applied to the tool bit, the weight is allowed to be driven by means of fluctuating pressure developed in the second chamber, while, under unloaded driving conditions, in which a load associated with the predetermined power tool operation is not applied to the tool bit, the weight is prevented from being driven by means of fluctuating pressure developed in the second chamber and the fluctuating pressure developed in the second chamber is released to the outside of the power tool under the unloaded driving conditions by communicating the second chamber to the outside.

5. The power tool as defined in claim 1, wherein the tool bit comprises a hammer bit that performs a predetermined hammer operation by applying a linear impact force to a work piece.

6. The power tool as defined in claim 1, wherein the actuating mechanism includes a piston and a cylinder that slide relative to each other in an axial direction of the tool bit, wherein the tool bit reciprocates in its axial direction by the action of an air spring which is caused by relative movement of the piston and the cylinder, and wherein the weight is disposed along a circumferential surface of the cylinder and can slide in the axial direction of the tool bit.

7. A power tool comprising:

a tool body; a tool holder; a tool bit coupled to the tool holder;

an actuating mechanism disposed in the tool body to drive the tool bit linearly by means of pressure fluctuations so as to cause the tool bit to perform a predetermined operation, wherein the actuating mechanism has a driving motor, a motion converting mechanism that converts a rotating output of the driving motor to a linear motion, a piston linearly reciprocating in a longitudinal direction of the tool bit via the motion converting mechanism, a striker disposed in front of the piston to cause the tool bit a linear motion, a first chamber between the striker and the piston, and a second chamber disposed adjacent to the piston within the tool body in an opposite side of the first chamber;

a dynamic vibration reducer having a weight that reciprocates under a biasing force of an elastic element to reduce vibration of the actuating mechanism, the weight being driven by means of pressure fluctuations caused in the second chamber when the piston reciprocates; and a cylinder that houses the striker such that the striker slidingly reciprocates within the cylinder, wherein the cylinder moves between a first position near the tool holder and a second position remote from the tool holder than the first position, and under loaded driving conditions in which a load associated with the predetermined operation is applied to the tool bit, the cylinder moves to the second position so as to allow the weight to be driven by means of fluctuating pressure within the second chamber, while, under unloaded driving conditions in which a load associated with the predetermined operation is not applied to the tool bit, the cylinder moves to the first position so as to prevent the weight from being driven by means of fluctuating pressure within the second chamber.

8. The power tool as defined in claim 7, wherein under the loaded driving conditions, the cylinder moves to the second position so as to allow the striker to be driven by the action of the air spring function of the first chamber, while, under unloaded driving conditions, the cylinder moves to the first position, so as to prevent the striker from being driven by the action of the air spring function of the first chamber.

9. The power tool as defined in claim 8, wherein under the loaded driving conditions, the weight is allowed to be driven by fluctuating pressure within the second chamber after the striker is allowed to be driven by the action of the air spring function of the first chamber.

10. The power tool as defined in claim 7, further comprising an air vent that can communicate the second chamber with the outside, wherein when the cylinder moves to the second position, the air vent is closed so as to allow the weight to be driven, and when the cylinder moves to the first position, the air vent is opened so as to prevent the weight to be driven.

11. The power tool as defined in claim 7, further comprising an air vent that can communicate the first chamber with the outside, wherein the air vent is closed when the cylinder moves to the second position and the air vent is opened when the cylinder moves to the first position.

* * * * *